US010875730B2

(12) United States Patent
Uchida et al.

(10) Patent No.: US 10,875,730 B2
(45) Date of Patent: Dec. 29, 2020

(54) SHEET CONVEYING DEVICE, IMAGE FORMING APPARATUS INCORPORATING THE SHEET CONVEYING DEVICE, AND SHEET CONVEYING METHOD USING THE SHEET CONVEYING DEVICE

(71) Applicants: Eri Uchida, Kanagawa (JP); Motoharu Takahashi, Kanagawa (JP); Yuichiro Maeyama, Kanagawa (JP); Tomohiro Egawa, Kanagawa (JP)

(72) Inventors: Eri Uchida, Kanagawa (JP); Motoharu Takahashi, Kanagawa (JP); Yuichiro Maeyama, Kanagawa (JP); Tomohiro Egawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 41 days.

(21) Appl. No.: 16/289,787

(22) Filed: Mar. 1, 2019

(65) Prior Publication Data

US 2019/0283998 A1 Sep. 19, 2019

(30) Foreign Application Priority Data

Mar. 16, 2018 (JP) ..... JP2018-049386

(51) Int. Cl.
*B65H 9/10* (2006.01)
*B65H 5/06* (2006.01)
(Continued)

(52) U.S. Cl.
CPC ..... *B65H 9/106* (2013.01); *B65H 5/062* (2013.01); *B65H 9/20* (2013.01); *B65H 26/02* (2013.01);
(Continued)

(58) Field of Classification Search
CPC . B65H 9/00; B65H 9/002; B65H 9/20; B65H 9/106; B65H 2301/331
(Continued)

(56) References Cited

U.S. PATENT DOCUMENTS

| | | | | |
|---|---|---|---|---|
| 7,472,905 | B2 * | 1/2009 | Inoue | B65H 9/006 271/227 |
| 2012/0025457 | A1 * | 2/2012 | Inoue | B65H 9/002 271/227 |
| 2015/0159598 | A1 | 6/2015 | Tagawa et al. | |

FOREIGN PATENT DOCUMENTS

| | | |
|---|---|---|
| JP | 6-234441 | 8/1994 |
| JP | 9-175694 | 7/1997 |

(Continued)

*Primary Examiner* — David H Bollinger
(74) *Attorney, Agent, or Firm* — Harness, Dickey & Pierce, P.L.C.

(57) ABSTRACT

A sheet conveying device includes a detector configured to detect an attitude of a conveyance target medium, a corrector configured to perform a correcting operation based on a detection result of the detector, and circuitry configured to calculate an angular displacement correction amount and a lateral displacement correction amount of the conveyance target medium, cause the corrector to perform the correcting operation in a direction perpendicular to a sheet conveying direction, based on the lateral displacement correction amount, after the corrector grips the conveyance target medium, and cause the corrector to rotate by the angular displacement correction amount of the conveyance target medium before the corrector grips the conveyance target medium and to perform the correcting operation in a direction of rotation of the conveyance target medium, based on the angular displacement correction amount, after the corrector grips the conveyance target medium.

11 Claims, 22 Drawing Sheets

(51) Int. Cl.
*B65H 9/20* (2006.01)
*B65H 26/02* (2006.01)

(52) U.S. Cl.
CPC .... *B65H 2301/12* (2013.01); *B65H 2301/331* (2013.01)

(58) Field of Classification Search
USPC ..... 271/227, 228
See application file for complete search history.

(56) References Cited

FOREIGN PATENT DOCUMENTS

| | | |
|---|---|---|
| JP | 10-067448 | 3/1998 |
| JP | 10-120253 | 5/1998 |
| JP | 2005-041603 | 2/2005 |
| JP | 2005-041604 | 2/2005 |
| JP | 2005-053646 | 3/2005 |
| JP | 2005-178929 | 7/2005 |
| JP | 2006-027859 | 2/2006 |
| JP | 2008-239348 | 10/2008 |
| JP | 2008-254843 | 10/2008 |
| JP | 2011-098790 | 5/2011 |
| JP | 2016-108152 | 6/2016 |
| JP | 2016-175776 | 10/2016 |

* cited by examiner

SHEET CONVEYING DEVICE, IMAGE FORMING APPARATUS INCORPORATING THE SHEET CONVEYING DEVICE, AND SHEET CONVEYING METHOD USING THE SHEET CONVEYING DEVICE

CROSS-REFERENCE TO RELATED APPLICATION

This patent application is based on and claims priority pursuant to 35 U.S.C. § 119(a) to Japanese Patent Application No. 2018-049386, filed on Mar. 16, 2018, in the Japan Patent Office, the entire disclosure of which is hereby incorporated by reference herein.

BACKGROUND

Technical Field

This disclosure relates to a sheet conveying device, an image forming apparatus incorporating the sheet conveying device, and a sheet conveying method using the sheet conveying device.

Related Art

When a sheet conveying device is conveying a sheet, the sheet is likely to have positional deviation in a direction of rotation of the sheet, in a width direction of the sheet or both. In a case in which such positional deviation of a sheet occurs while the sheet is being conveyed in an image forming apparatus that forms an image on a sheet, an image forming position at which an image is formed on the sheet is shifted from an ideal image forming position. Therefore, the image forming position is corrected.

Therefore, it is known that, before an image is formed on a sheet, various sheet conveying devices detect the attitude of the sheet to correct the shifted positional deviation of the sheet. For example, a detector is disposed upstream from a pair of sheet conveying rollers having a nip region at which the pair of sheet conveying direction grips a sheet, and detects an angular displacement of the sheet (that is, a displacement of the sheet in a direction of rotation of the sheet) while the sheet is being conveyed. According to the detection result of the detector, the pair of sheet conveying rollers rotates so that the nip region of the pair of sheet conveying rollers comes to be parallel to the leading end of the sheet. Then, the pair of sheet conveying rollers grips the sheet at the nip region and rotates until the angle of rotation of the sheet reaches the right angle to a sheet conveying direction. Thereafter, in a case in which there is a lateral displacement of the sheet, it is disclosed that the pair of sheet conveying rollers is moved in the width direction to correct the displacement of the sheet in the width direction (i.e., the lateral displacement of the sheen is corrected.

SUMMARY

At least one aspect of this disclosure provides a sheet conveying device including a detector, a corrector, and circuitry. The detector is configured to detect an attitude of a conveyance target medium conveyed in a sheet conveying direction of the conveyance target medium. The corrector is configured to perform a correcting operation in which the corrector conveys the conveyance target medium while gripping the conveying target medium and corrects, based on a detection result of the detector, the attitude of the conveyance target medium in a direction of rotation of the conveyance target medium relative to the sheet conveying direction and a direction perpendicular to the sheet conveying direction. The circuitry is configured to control the corrector to perform a correcting operation. The circuitry is configured to calculate, based on the detection result of the detector, an angular displacement correction amount to correct an angular displacement of the conveyance target medium in the direction of rotation of the conveyance target medium and a lateral displacement correction amount to correct a lateral displacement of the conveyance target medium in the direction perpendicular to the sheet conveying direction, while the conveyance target medium is being conveyed, cause the corrector to perform the correcting operation in the direction perpendicular to the sheet conveying direction, based on the lateral displacement correction amount, after the corrector grips the conveyance target medium, and cause the corrector to rotate by the angular displacement correction amount of the conveyance target medium before the corrector grips the conveyance target medium and to perform the correcting operation in the direction of rotation of the conveyance target medium, based on the angular displacement correction amount, after the corrector grips the conveyance target medium.

Further, at least one aspect of this disclosure provides an image forming apparatus including a sheet container in which a conveyance target medium is stored, an image forming device configured to form an image on the conveyance target medium, the above-described sheet conveying device configured to convey the conveyance target medium from the sheet container to the image forming device, and a sheet ejecting device from which the conveyance target medium having the image is ejected.

Further, at least one aspect of this disclosure provides a sheet conveying method including detecting an attitude of a conveyance target medium conveyed in a sheet conveying direction of the conveyance target medium, gripping and conveying the conveyance target medium, calculating an angular displacement correction amount to correct an angular displacement of the conveyance target medium based on a detection result detected by the detecting, while the conveyance target medium is being conveyed, calculating a lateral displacement correction amount to correct a lateral displacement of the conveyance target medium in a direction perpendicular to the sheet conveying direction, based on the detection result detected by the detecting, while the conveyance target medium is being conveyed, performing a correcting operation in the direction perpendicular to the sheet conveying direction, based on the lateral displacement correction amount, after gripping the conveyance target medium, rotating by the angular displacement correction amount of the conveyance target medium before the gripping, and performing the correcting operation in the direction of rotation of the conveyance target medium, based on the angular displacement correction amount, after gripping the conveyance target medium.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
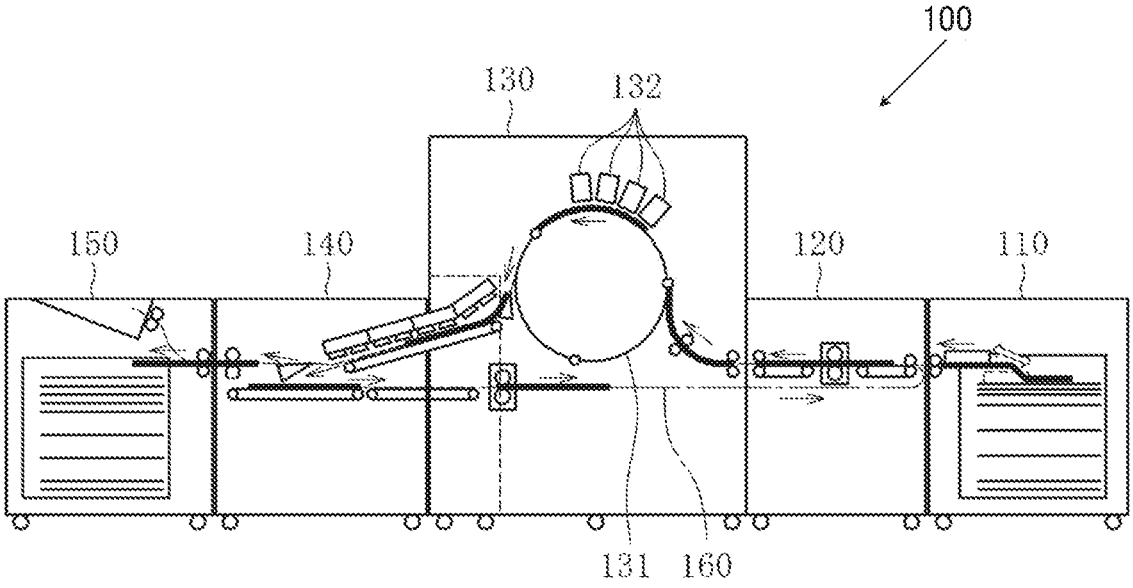
FIG. 1 is a diagram illustrating a schematic configuration of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an example applicable to a sheet conveying device, an image forming apparatus incorporating the sheet conveying device, and a sheet conveying method using the sheet conveying device.

It is to be noted that elements (for example, mechanical parts and components) having the same functions and shapes are denoted by the same reference numerals throughout the specification and redundant descriptions are omitted.

A sheet conveying device according to this disclosure corrects the attitude of a sheet-shaped conveyance target medium to the proper attitude according to the detection result of a sensor (or sensors) that detects the attitude of the sheet-shaped conveyance target medium while the sheet-shaped conveyance target medium is being conveyed. The sensor that is provided to this sheet conveying device detects, at one detection, both a positional deviation in a direction of rotation of the conveyance target medium with respect to the sheet conveying direction of the conveyance target medium (i.e., an angular displacement of the conveyance target medium) and a positional deviation in a direction perpendicular to or intersecting the sheet conveying direction (i.e., a lateral displacement of the conveyance target medium). The sheet conveying device includes a pair of rollers that conveys a conveyance target medium while gripping the conveyance target medium. The pair of rollers rotates in a direction of rotation of the conveyance target medium (i.e., a direction in which the pair of rollers is disposed parallel to the leading end of the conveyance target medium in the sheet conveying direction) according to an amount of angular displacement of the conveyance target medium detected by a sensor. Thereafter, while gripping the conveyance target medium, the pair of rollers rotates in the direction of rotation of the conveyance target medium to correct the angular displacement of the conveyance target medium and, at the same time, moves in the width direction to correct the lateral displacement of the conveyance target medium. That is, the sheet conveying device according to this disclosure provides a function in which the amount of angular displacement of the conveyance target medium and the amount of lateral displacement of the conveyance target medium are detected at one detection and correction of the angular displacement of the conveyance target medium and correction of the lateral displacement of the conveyance target medium are performed at the same time.

Now, a description is given of the sheet conveying device according to this disclosure with reference to the following figures.

First, referring to FIG. 1, a description is given of an entire configuration of an image forming apparatus that includes a sheet conveying device according to an embodiment of this disclosure.

FIG. 1 is a diagram illustrating an entire configuration of an inkjet image forming apparatus 100 according to an embodiment of this disclosure.

The image forming apparatus 100 may be a copier, a facsimile machine, a printer, a multifunction peripheral or a multifunction printer (NFP) having at least one of copying, printing, scanning, facsimile, and plotter functions, or the like. According to the present example, the image forming apparatus 100 is an inkjet image forming apparatus that forms toner images on recording media by discharging ink to the recording media.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., an OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

As illustrated in FIG. 1, the inkjet image forming apparatus 100 includes a sheet feeding device 110, a sheet conveying device 120, an image forming device 130, a drying device 140, and a sheet ejecting device 150.

A sheet 17 is a sheet-shaped conveyance target medium that is fed from the sheet feeding device 110 that functions as a sheet container. The sheet 17 is fed by the sheet conveying device 120 to be conveyed to the image forming device 130.

In the image forming device 130, the sheet 17 is positioned to a cylindrical drum 131. Together with rotation of the cylindrical drum 131, the sheet 17 is conveyed in a direction indicated by arrow in FIG. 1. Then, the sheet 17 is conveyed to a lower portion of liquid discharging heads 132 from which liquid ink of each color is discharged (that is, the image forming position on the sheet 17) at a predetermined timing. Then, liquid ink of each color is discharged onto the sheet 17, so that an image is formed on a surface of the sheet 17.

The sheet 17 on which the image is formed by the image forming device 130 is conveyed to the drying device 140 in which moisture in the ink is evaporated. Then, the sheet 17 is further conveyed to a sheet ejecting device 150 that includes a sheet ejecting portion to a position at which a user takes out the sheet 17.

When a duplex printing is performed to the sheet 17, the sheet 17 after completion of a series of processes in the drying device 140 is conveyed to a sheet reversal passage 160 to be further conveyed to the sheet conveying device 120 in a state in which the sheet 17 is reversed with the front face down.

The above-described sheet conveying device 120 corresponds to a sheet conveying device according to this disclosure. Details of the sheet conveying device 120 are given below. That is, the sheet conveying device 120 corrects both the "angular displacement" that is a positional deviation of the sheet 17 in the direction of rotation of the sheet 17 with respect to the sheet conveying direction of the sheet 17 and the "lateral displacement" that is a positional deviation of the sheet 17 in the width direction of the sheet 17. Hereinafter, the angular displacement of the sheet 17 and the lateral displacement of the sheet 17 generated during conveyance of the sheet 17 are also described as "positional deviations" of the sheet 17. The sheet conveying device 120 corrects the positional deviations of the sheet 17 while conveying the sheet 17 at high speed. Then, the sheet 17 is conveyed, in a state in which the positional deviations of the sheet 17 are corrected, to the image forming device 130 that is disposed downstream from the sheet conveying device 120 in the sheet conveying direction.

It is to be noted that the "sheet" includes the sheet 17 (e.g., plain papers), thick papers, postcards, envelopes, thin papers, coated papers (including art papers, etc.), tracing papers, overhead projector (OHP) sheets, plastic films, prepreg, copper foil, etc.

Figure 2A:
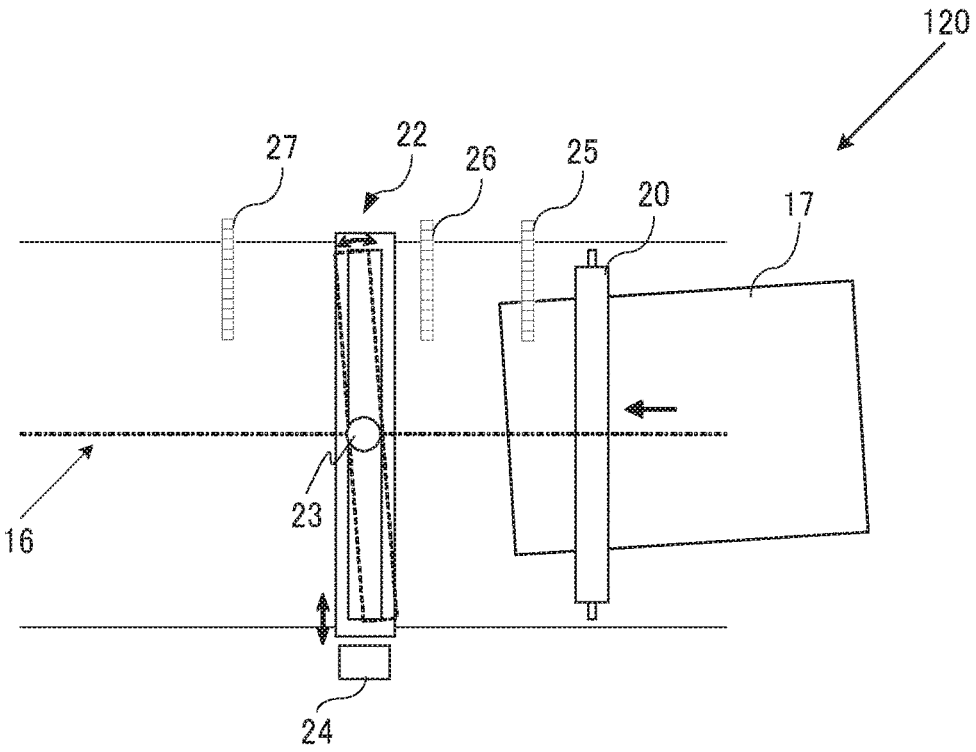
FIG. 2A is a plan view illustrating the configuration of a sheet conveying device according to an embodiment of this disclosure.
Figure 2B:
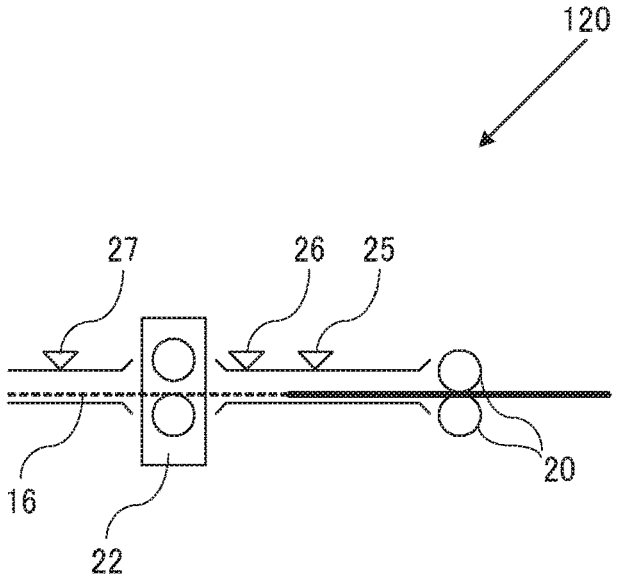
FIG. 2B is a side view illustrating the sheet conveying device of FIG. 2A.

Next, a description is given of a configuration of the sheet conveying device 120 according to the present embodiment of this disclosure, with reference to FIGS. 2A and 2B.

FIG. 2A is a plan view illustrating the configuration of the sheet conveying device 120, viewed from above a sheet conveyance passage of the sheet 17. FIG. 2B is a side view illustrating the configuration of the sheet conveying device 120, viewed from one side of the sheet conveyance passage of the sheet 17.

The conveying device 120 includes a sheet conveyance passage 16, a pair of sheet conveying rollers 20, and a registration mechanism 22. The sheet conveyance passage 16 conveys the sheet 17 that is fed from the sheet feeding device 110 illustrated in FIG. 1. The pair of sheet conveying rollers 20 that functions as a conveying portion to convey the sheet 17 to the registration mechanism 22. The registration mechanism 22 is disposed downstream from the pair of sheet conveying rollers 20 in the sheet conveyance direction. The registration mechanism 22 includes a pair of registration rollers. It is to be noted that the pair of sheet conveying rollers 20 and the registration mechanism 22 include respective drive devices. According to this configuration, rollers of the pair of sheet conveying rollers 20 separate and contact freely, and similarly rollers of the pair of registration rollers of the registration mechanism 22 also separate and contact freely.

A first edge sensor 25 and a second edge sensor 26 are disposed upstream from the registration mechanism 22 in the sheet conveyance passage 16.

The registration mechanism 22 includes a registration drive device, a contact and separation device, a rotation drive device 23, and a main scanning drive device 24. The registration drive device controls rotation of the pair of registration rollers to convey the sheet 17. The contact and separation device controls a contacting and separating operation of the rollers of the pair of registration rollers of the registration mechanism 22. The rotation drive device 23 controls the pair of registration rollers to rotate a gripping portion of the pair of registration rollers with respect to the sheet conveying direction to correct the angular displacement of the sheet 17. The main scanning drive device 24 controls the pair of registration rollers to move in a direction perpendicular to the sheet conveying direction of the sheet 17 (i.e., a main scanning direction of the sheet 17) to correct the lateral displacement in the main scanning direction of the sheet 17. That is, the registration mechanism 22 includes a correcting member that corrects the attitude of the sheet 17 that functions as a conveyance target medium while the sheet 17 is being conveyed.

The rotation drive device 23 includes a measuring unit to measure an amount of rotation of the pair of registration rollers from an initial state of the pair of registration rollers (i.e., a home position). The main scanning drive device 24 includes a measuring unit to measure an amount of lateral shift of the pair of registration rollers from the initial state of the pair of registration rollers (i.e., the home position). The measuring unit to measure the amount of rotation of the pair of registration rollers includes an encoder that is mounted on a rotation motor 23*a* to rotate the rotation drive device 23 or on a cam that is connected to the rotation motor 23*a*. Similarly, the measuring unit to measure the amount of lateral movement of the pair of registration rollers includes an encoder that is mounted on a shift motor 24*a* to drive the main scanning drive device 24 or on a cam that is connected to the shift motor 24*a*.

Next, a description is given of a configuration of a detector that detects the attitude of the sheet 17 while the sheet 17 is being conveyed through the sheet conveyance passage 16.

The first edge sensor 25 and the second edge sensor 26 are disposed upstream from the registration mechanism 22 in the sheet conveying direction. In addition, a third edge sensor 27 is disposed downstream from the registration mechanism 22 in the sheet conveying direction. Each of the first edge sensor 25, the second edge sensor 26, and the third edge sensor 27 employs a contact image sensor (CIS) so as to detect each position of the edge of the sheet 17 in the main scanning direction. Therefore, based on the position of the edge of the sheet 17 detected by the first edge sensor 25 and the position of the edge of the sheet 17 detected by the second edge sensor 26, it is detected whether the sheet 17 has an angular displacement with respect to the sheet conveying direction, a lateral displacement in the main scanning direction, and the amount of the angular displacement and the amount of the lateral displacement, if any. Similarly, based on the position of the edge of the sheet 17 detected by the second edge sensor 26 and the position of the edge of the sheet 17 detected by the third edge sensor 27, it is detected whether the sheet 17 has an angular displacement with respect to the sheet conveying direction, the lateral displacement in the main scanning direction, and the amount of the angular displacement and the amount of the lateral displacement, if any. The first edge sensor 25 and the second edge sensor 26 form a first detector. The second edge sensor 26 and the third edge sensor 27 form a second detector.

Figure 3:
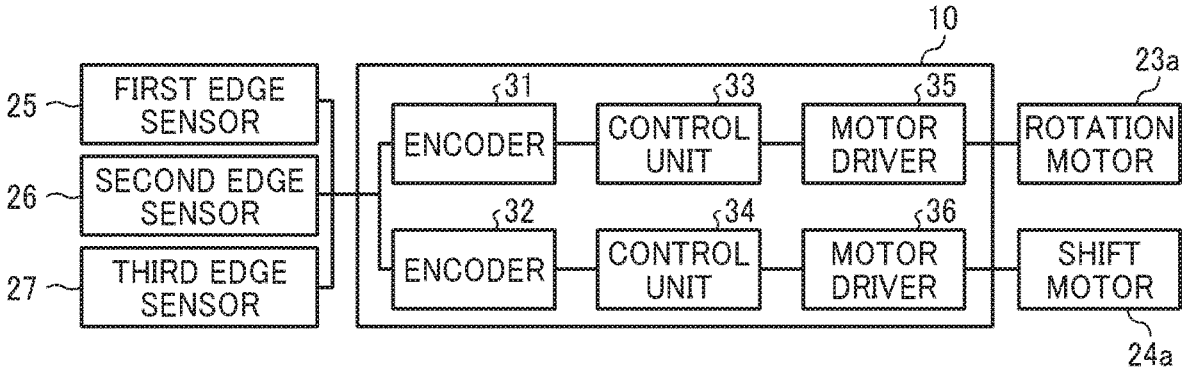
FIG. 3 is a functional block diagram illustrating a controller included in the sheet conveying device according to an embodiment of this disclosure.

FIG. 3 is a functional block diagram of the sheet conveying device 120 according to the present embodiment of this disclosure.

As described above, the sheet conveying device 120 detects the attitude of the sheet 17 while the sheet 17 is being conveyed (i.e., whether there are the angular displacement of the sheet 17 and the lateral displacement of the sheet 17) based on the respective positions of the edge of the sheet 17 in the main scanning direction of the sheet 17 detected by the first edge sensor 25, the second edge sensor 26, and the third edge sensor 27. Consequently, the correction amount of the attitude of the sheet 17 while being conveyed is determined based on the detection results of the first edge sensor 25, the second edge sensor 26, and the third edge sensor 27. Based on the detected correction amounts, encoders 31 and 32 calculate respective numbers of encoder counts. The number of calculated encoder counts of the encoder 31 is input to a control unit 33 to drive the registration mechanism 22. Similarly, the number of calculated encoder counts of the encoder 32 is input to a control unit 34 to drive the registration mechanism 22. According to the number of input encoder counts of the encoder 31, a motor driver 35 drives the rotation motor 23*a* of the rotation drive device 23. Similarly, according to the number of input encoder counts of the encoder 32, a motor driver 36 drives the shift motor 24*a* of the main scanning drive device 24. By controlling the rotation motor 23*a* and the shift motor 24*a* as described above, an attitude correcting operation of the sheet 17 is performed by the registration mechanism 22. That is, the encoders 31 and 32, the control unit 33, the control unit 34, and the motor drivers 35 and 36 form a controller 10 to control the operation of the registration mechanism 22.

Next, a description is given of a sheet conveying method according to this disclosure with the attitude correcting operation of the sheet 17 performed in the sheet conveying device 120 according to the present embodiment of this disclosure and with reference to flowcharts and timing diagrams.

First, an overview of the flow of the attitude correcting operation is described with reference to the flowchart of FIG. 4.

Figure 4:
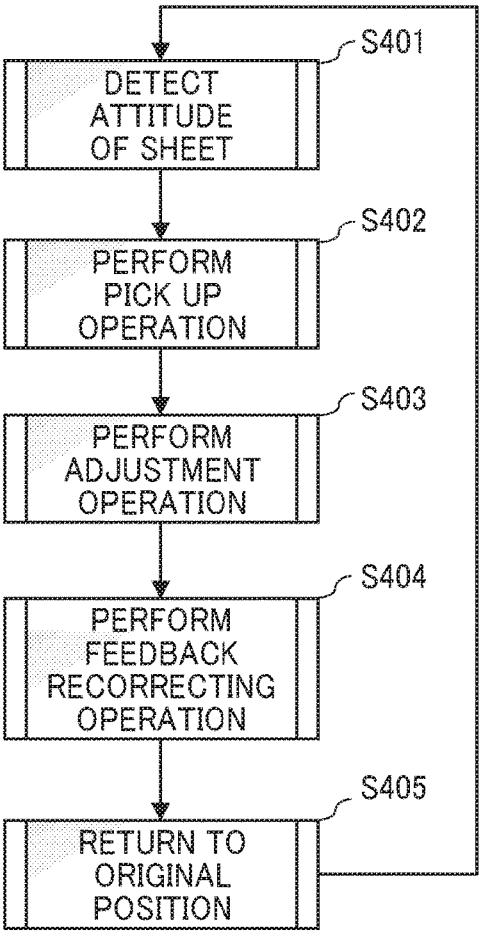
FIG. 4 is a flowchart of a sheet conveying method according to an embodiment of this disclosure.

First, when the sheet 17 is conveyed to a predetermined position, the attitude of the sheet 17 during conveyance is detected (step S401 in the flowchart of FIG. 4). Then, the registration mechanism 22 performs a "pick up operation" that is an operation in which the pair of registration rollers moves in the direction of rotation of the registration mechanism 22 according to the detected attitude of the sheet 17 (step S402 in the flowchart of FIG. 4). Details of the pick up operation are described below.

Subsequently, the registration mechanism 22 performs an "adjustment operation" along with the pick up operation (step S403 in the flowchart of FIG. 4). Details of the adjustment operation are described below.

Subsequently, when the sheet 17 reaches a predetermined position to be conveyed by the registration mechanism 22, the registration mechanism 22 performs a feedback recorrecting operation (step S404 in the flowchart of FIG. 4). Details of the feedback recorrecting operation are described below.

Then, a position returning operation is performed to cause the registration mechanism 22 to return to an original position (the home position) of the registration mechanism 22 (step S405 in the flowchart of FIG. 4). After the position returning operation, the procedure goes back to step S401 to prepare for a subsequent sheet (in other words, a subsequent conveyance target medium).

Now, a description is given of details of each operation with respective examples of a comparative sheet conveying device so as to clarify the features of operations of the sheet conveying device 120 according to the present embodiment of this disclosure.

First, the details of the attitude detecting operation (step S401 in the flowchart of FIG. 4) are described with reference to FIG. 5. The attitude detecting operation performed by the comparative sheet conveying device is the same as the attitude detecting operation performed by the sheet conveying device 120 according to the present embodiment of this disclosure.

Figure 5:
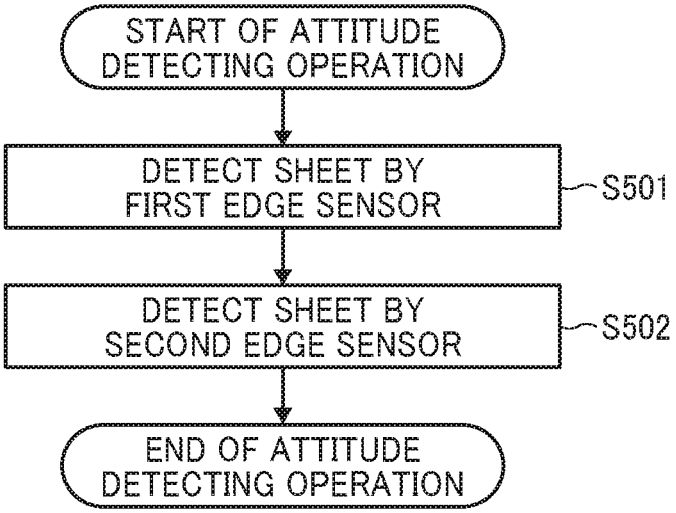
FIG. 5 is a flowchart of an attitude detecting operation according to an embodiment of this disclosure.

First, the first edge sensor 25 detects the edge of the sheet 17 conveyed by the pair of sheet conveying rollers 20, in the width direction of the sheet 17 (i.e., the main scanning direction) (step S501 in the flowchart of FIG. 5). Then, when the sheet 17 reaches the second edge sensor 26, the second edge sensor 26 detects the edge of the sheet 17 in the width direction (i.e., the main scanning direction) (step S502 in the flowchart of FIG. 5). As described above, in the attitude detecting operation, a plurality of sensors (i.e., the first edge sensor 25 and the second edge sensor 26) disposed upstream from the registration mechanism 22 in the sheet conveying direction detect the edge of the sheet 17 in the width direction (i.e., the main scanning direction). Thereafter, based on the detection results of the plurality of sensors (i.e., the first edge sensor 25 and the second edge sensor 26), a correcting operation of the attitude of the sheet 17 is performed (i.e., the pick up operation and the adjustment operation).

Figure 6:
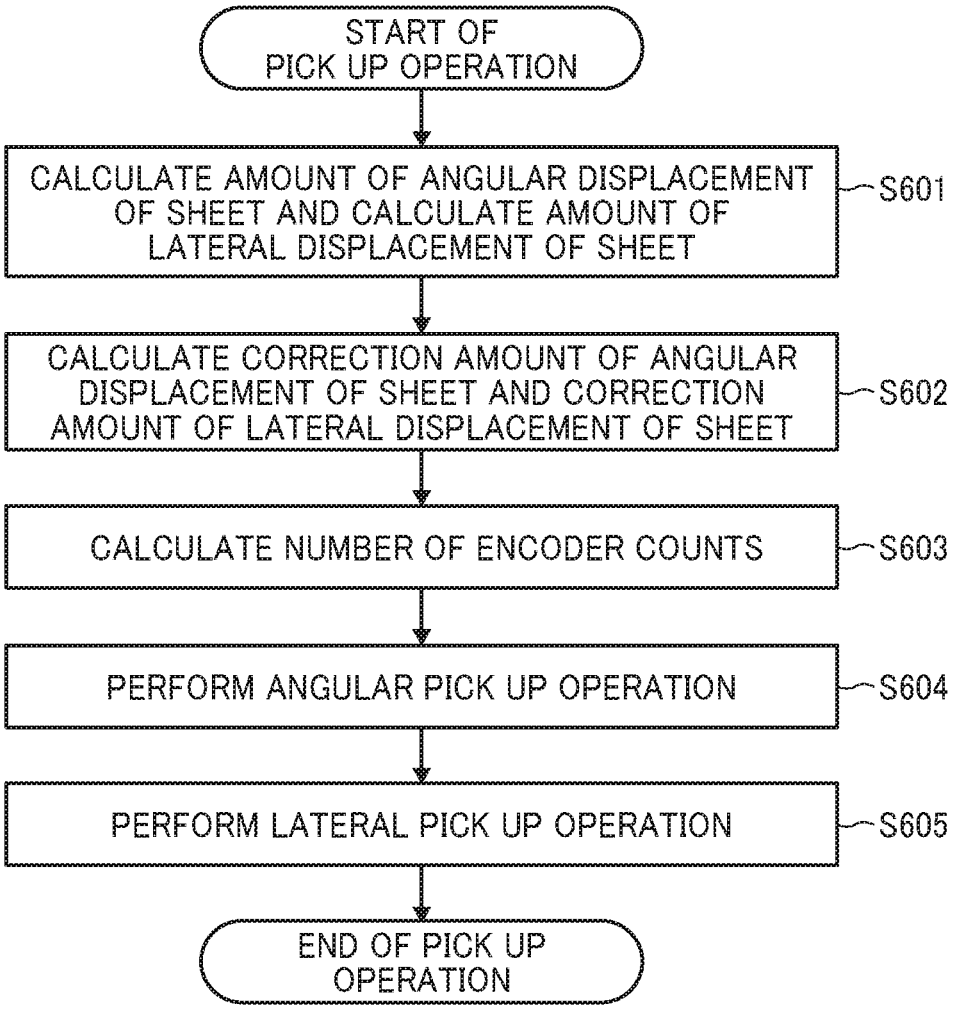
FIG. 6 is a flowchart of a pick up operation performed by a comparative sheet conveying device.
Figure 7:
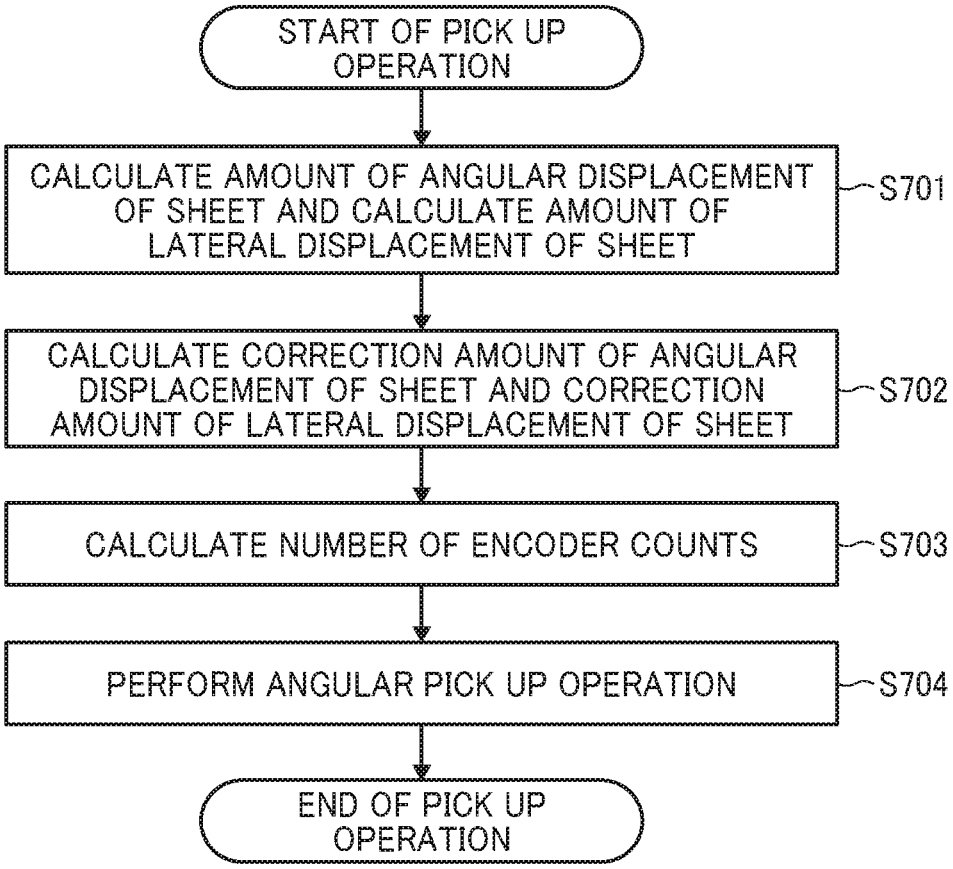
FIG. 7 is a flowchart of a pick up operation performed by the sheet conveying device according to an embodiment of this disclosure.

Next, a description is given of details of the pick up operation with reference to FIGS. 6 and 7.

FIG. 6 is a flowchart of a pick up operation performed by the comparative sheet conveying device. FIG. 7 is a flowchart of the pick up operation performed by the sheet conveying device 120 according to an embodiment of this disclosure.

First, based on the position of the edge of the sheet 17 detected by the first edge sensor 2 and the position of the edge of the sheet 17 detected by the second edge sensor 26, an amount of angular displacement and an amount of lateral displacement of the sheet 17 with respect to the sheet conveying direction of the sheet 17 are calculated (step S601 in the flowchart of FIGS. 6 and 5701 in the flowchart of FIG. 7). Subsequently, a correction amount of angular displacement and a correction amount of lateral displacement are calculated to be used to correct the amount of angular displacement and the amount of lateral displacement of the sheet 17 (step S602 in the flowchart of FIG. 6 and S702 in the flowchart of FIG. 7). Then, the number of encoder counts corresponding to the correction amount of angular displacement and the number of encoder counts corresponding to the correction amount of lateral displacement are calculated (step S603 in the flowchart of FIG. 6 and S703 in the flowchart of FIG. 7).

Subsequently, by using the number of encoder counts corresponding to the correction amount of angular displacement calculated in step S603 in the flowchart of FIG. 6 and S703 in the flowchart of FIG. 7, the operation of the rotation motor 23*a* is controlled to perform a "rotational operation (an angular pick up operation)" in which the pair of registration rollers of the registration mechanism 22 is rotated to be parallel to the leading end of the sheet 17 in the sheet conveying direction (step S604 in the flowchart of FIG. 6 and S704 in the flowchart of FIG. 7). Thereafter, in the comparative sheet conveying device, the operation of the shift motor 24*a* is controlled according to the number of encoder counts corresponding to the correction amount of lateral displacement calculated in step S603 in the flowchart of FIG. 6 and S703 in the flowchart of FIG. 7, so that a "lateral pick up operation" in which the pair of registration rollers of the registration mechanism 22 is moved in a direction perpendicular to the sheet conveying direction is performed (step S605 in the flowchart of FIG. 6). By contrast, the sheet conveying device 120 according to the present embodiment of this disclosure does not perform the lateral correction pick up operation that corrects the lateral displacement of the sheet 17. Accordingly, the time taken for the pick up operation is reduced.

Figure 8:
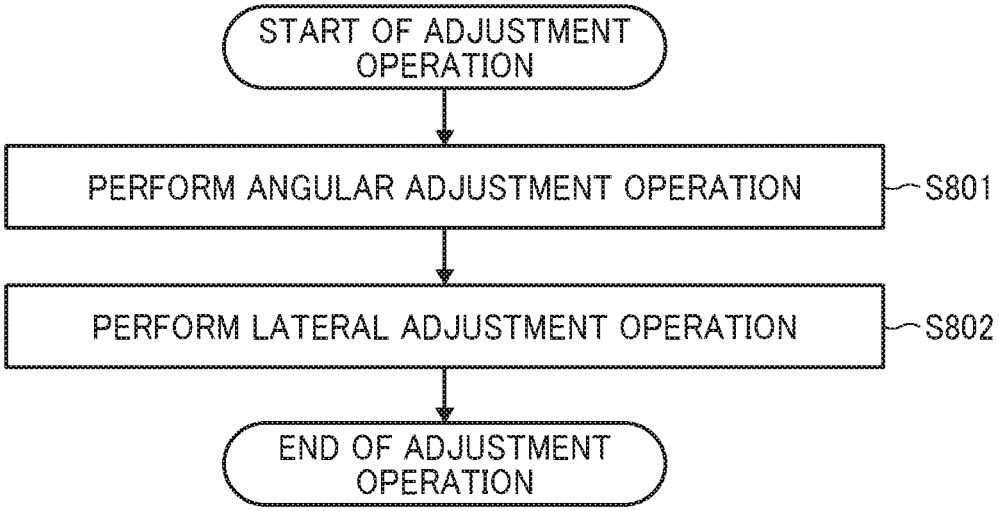
FIG. 8 is a flowchart of an adjustment operation performed by the comparative sheet conveying device.
Figure 9:
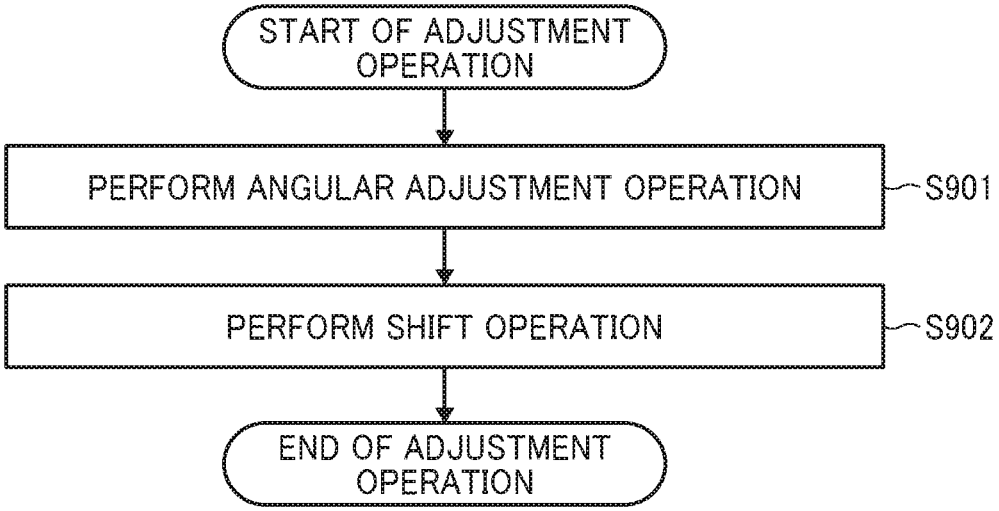
FIG. 9 is a flowchart of an adjustment operation performed by the sheet conveying device according to an embodiment of this disclosure.

Next, a description is given of details of the adjustment operation ith reference to FIGS. 8 and 9.

FIG. 8 is a flowchart of an adjustment operation performed by the comparative sheet conveying device. FIG. 9 is a flowchart of the adjustment operation performed by the sheet conveying device 120 according to an embodiment of this disclosure.

First, the operation of the rotation motor 23*a* provided to the rotation drive device 23 is controlled to perform an angular adjustment operation to correct the angular displacement of the sheet 17 (step S801 in the flowchart of FIG. 8 and S901 in the flowchart of FIG. 9). Thereafter, in the comparative sheet conveying device, the operation of the shift motor 24*a* provided to the main scanning drive device 24 is controlled to perform a lateral adjustment operation to correct the lateral displacement of the sheet 17 (step S802 in the flowchart of FIG. 8). By contrast, the sheet conveying device 120 according to the present embodiment of this disclosure does not perform the lateral adjustment operation that corrects the lateral displacement of the sheet 17. Therefore, the lateral adjustment operation in a shift direction (i.e., the main scanning direction) is not performed. Instead of the lateral adjustment operation, a "shift operation" is performed to move the pair of registration rollers of the registration mechanism 22 in a direction to correct the lateral displacement of the sheet 17 (i.e., in a direction to cancel or eliminate the amount of lateral displacement of the sheet 17) by using the number of encoder counts that is calculated in step S703 in the flowchart of FIG. 7 (step S902 in the flowchart of FIG. 9).

As described above, the sheet conveying device 120 according to the present embodiment of this disclosure does not perform the lateral pick up operation to correct the lateral displacement of the sheet 17 in the pick up operation (in step S402 in the flowchart of FIG. 4) but performs the correction of angular displacement of the sheet 17 and the correction of lateral displacement of the sheet 17 in the adjustment operation at the same time. According to this operation, the period of a sheet position correction time for correction of the positional deviation of the sheet 17 is reduced.

Figure 10:
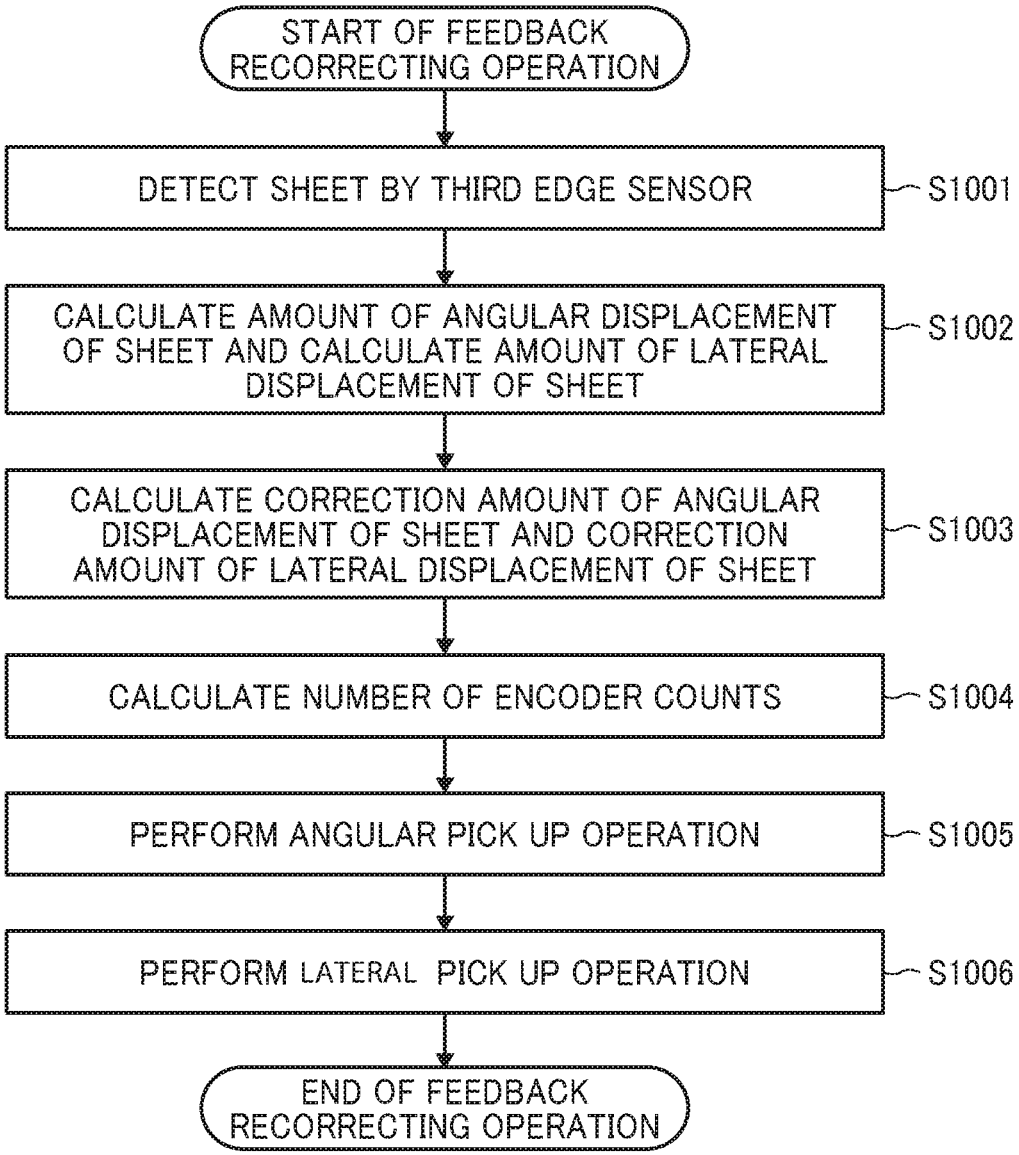
FIG. 10 is a flowchart of a feedback recorrecting operation performed by the sheet conveying device according to an embodiment of this disclosure.
Figure 11:
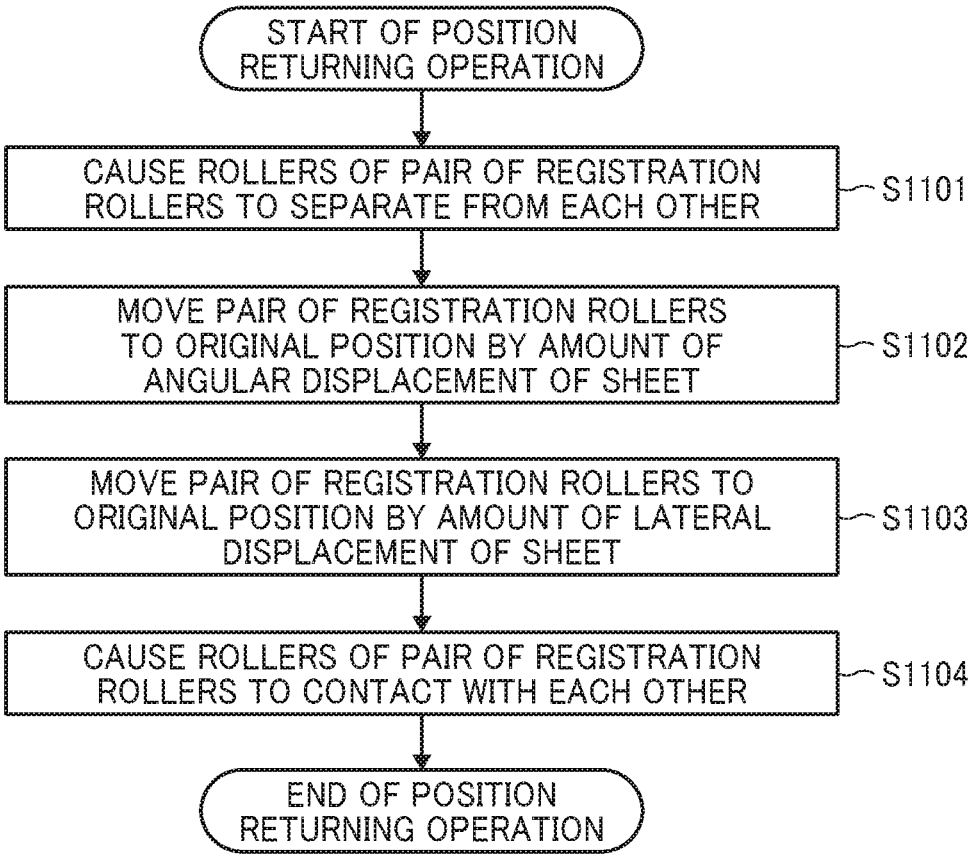
FIG. 11 is a flowchart of a position returning operation performed by the sheet conveying device according to an embodiment of this disclosure.

Next, a detailed description is given of a feedback recorrecting operation performed by the sheet conveying device 120 with reference to FIG. 10 and a position returning operation performed by the sheet conveying device 120 with reference to FIG. 11.

The adjustment operation performed by the sheet conveying device 120 according to the present embodiment of this disclosure is the same operation as the adjustment operation performed by the comparative sheet conveying device.

First in the feedback recorrecting operation, the third edge sensor 27 detects the sheet 17 (step S1001 in the flowchart of FIG. 10). At this time, the second edge sensor 26 has continuously detected the sheet 17. Then, based on the position of the edge of the sheet 17 detected by the second edge sensor 26 and the position of the edge of the sheet 17 detected by the third edge sensor 27, the amounts of positional deviation of the sheet 17 (i.e., the amount of angular displacement of the sheet 17 and the amount of lateral displacement of the sheet 17) with respect to the sheet conveying direction of the sheet 17 are calculated (step S1002 in the flowchart of FIG. 10). Subsequently, the correction amount of angular displacement to be used to correct the amount of angular displacement of the sheet 17 and the correction amount of lateral displacement to be used to correct the amount of lateral displacement of the sheet 17, both calculated in step S1002, are calculated (step S1003 in the flowchart of FIG. 10). Then, the number of encoder counts corresponding to the correction amount of angular displacement and the number of encoder counts corresponding to the correction amount of lateral displacement are calculated (step S1004 in the flowchart of FIG. 10).

Thereafter, the operation of the rotation motor 23*a* is controlled by using the number of encoder counts corresponding to the correction amount of angular displacement and the number of encoder counts corresponding to the correction amount of lateral displacement, the operation of the rotation motor 23*a* is controlled using the calculated number of encoder counts, and the pair of registration rollers of the registration mechanism 22 is moved in a direction in which the amount of angular displacement of the sheet 17 is corrected (S1005 in the flowchart of FIG. 10). After step S1005, the pair of registration rollers is moved in a direction to correct the lateral displacement of the sheet 17 (step S1006 in the flowchart of FIG. 10). The sheet 17 is detected for multiple times in step S1001. Each time the sheet 17 is detected in step S1001, the processes in steps S1002 through S1006 in the flowchart of FIG. 10 are executed continuously. In other words, in the feedback recorrecting operation, each time the third edge sensor 27 detects the sheet 17, the correction amount of angular displacement and the correction amount of lateral displacement are calculated (step S1003 in the flowchart of FIG. 10), an angular recorrecting operation is performed (step S1005 in the flowchart of FIG. 10), and a lateral recorrecting operation is performed (step S1006 in the flowchart of FIG. 10).

Subsequently, first in the position returning operation, the rollers of the pair of registration rollers are separated from each other (step S1101 in the flowchart of FIG. 11) The separation of the rollers of the pair of registration rollers causes the registration mechanism 22 to release the sheet 17 from the nip region of the pair of registration rollers. In the state in which the rollers of the pair of registration rollers are separated, even if the pair of registration rollers starts to rotate, this rotation does not change the attitude of the sheet 17. In order to prepare for a subsequent sheet 17 (i.e., a subsequent conveyance target medium) to be conveyed to the pair of registration rollers, the rotation drive device 23 performs the position returning operation to cause a rotation position of the pair of registration rollers to return to the original position (step S1102 in the flowchart of FIG. 11). Then, the main scanning drive device 24 performs the origin returning operation to cause a shift position of the pair of registration rollers to return to the original position (step S1103 in the flowchart of FIG. 11), Then, the rollers of the pair of registration rollers that has returned to the original position contact to each other (step S1104 in the flowchart of FIG. 11). According to this operation, when a subsequent sheet 17 is conveyed, the pair of registration rollers grips the subsequent sheet 17, so that preparation for correction of the positional deviation of the subsequent sheet 17 is completed.

Figure 12:
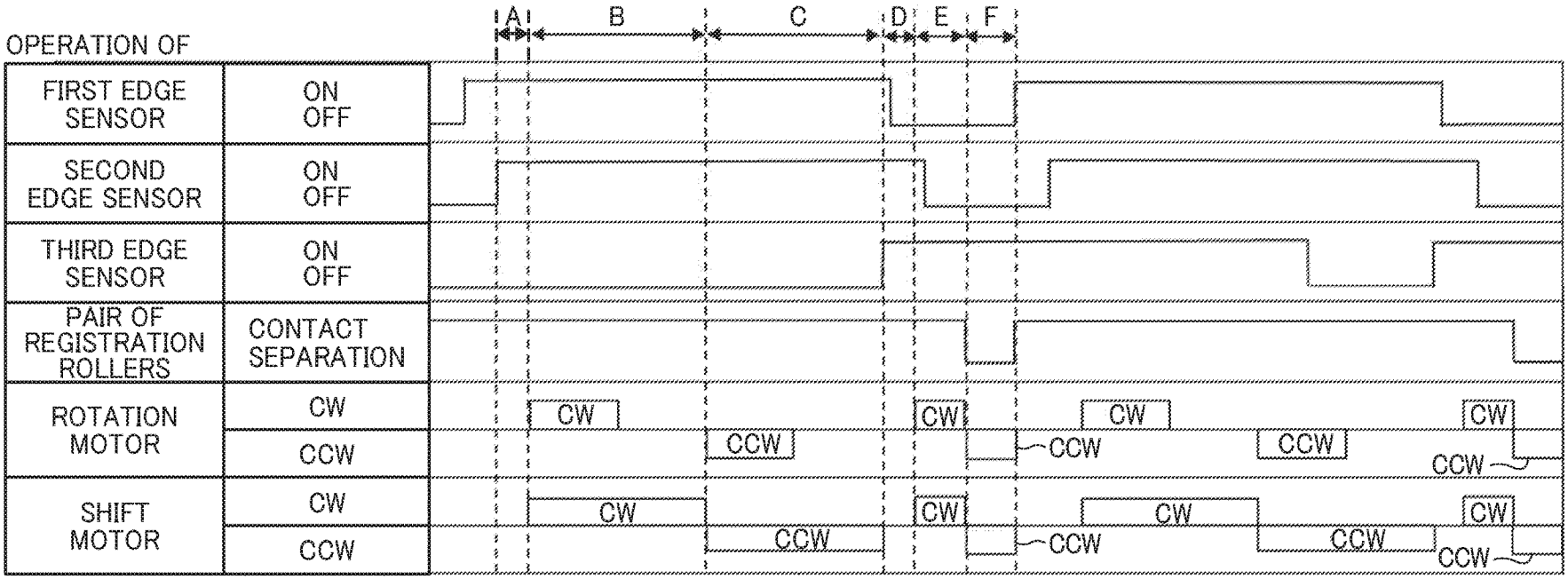
FIG. 12 is a timing diagram illustrating a sheet conveying operation of the comparative sheet conveying device.
Figure 13:
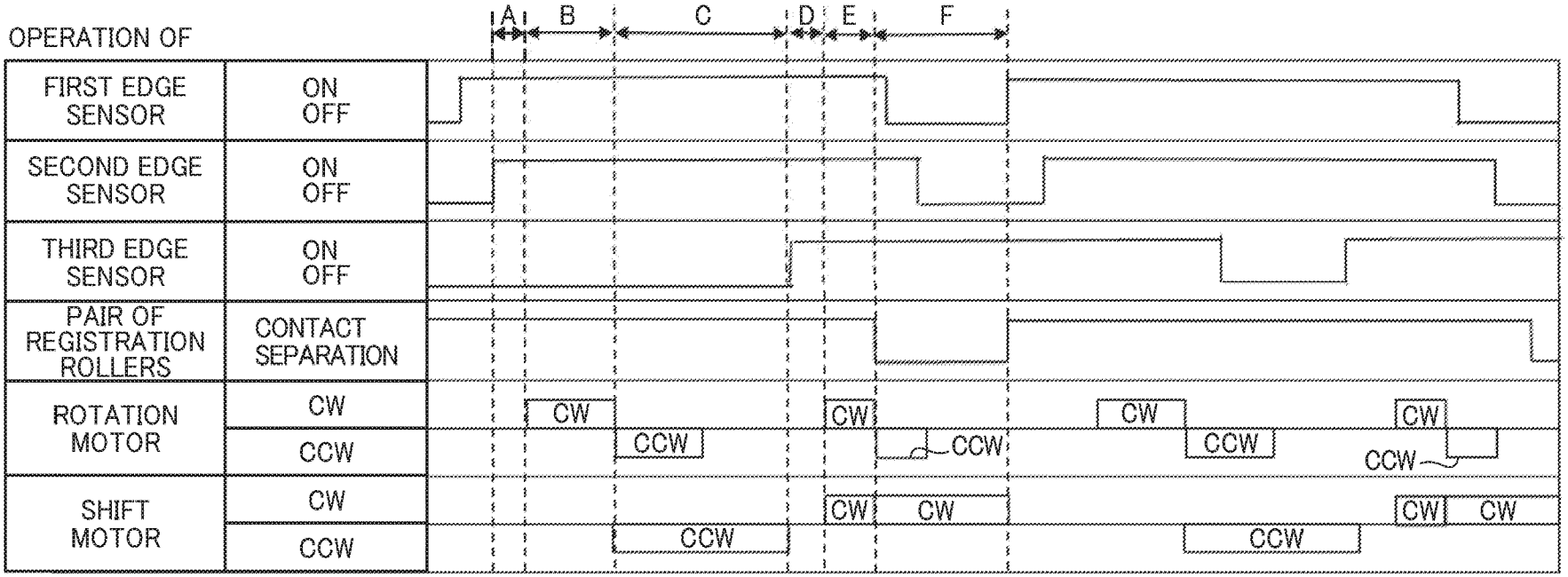
FIG. 13 is a timing diagram illustrating a sheet conveying operation performed by the sheet conveying device according to an embodiment of this disclosure.

Next, a detailed description is given of the operation of the sheet conveying device 120 according to the present embodiment of this disclosure, with reference to timing diagrams illustrated in FIGS. 12 and 13. The description explains the difference between the sheet conveying device 120 and the comparative sheet conveying device while comparing the timing diagram of the comparative sheet conveying device of FIG. 12 and the timing diagram of the sheet conveying device 120 of FIG. 13.

The following description is also given with reference to FIGS. 14 through 20. FIGS. 14 through 20 illustrate respective states of the sheet 17 corresponding to each of Times A through in the timing diagrams of FIGS. 12 and 13.

Figure 15A:
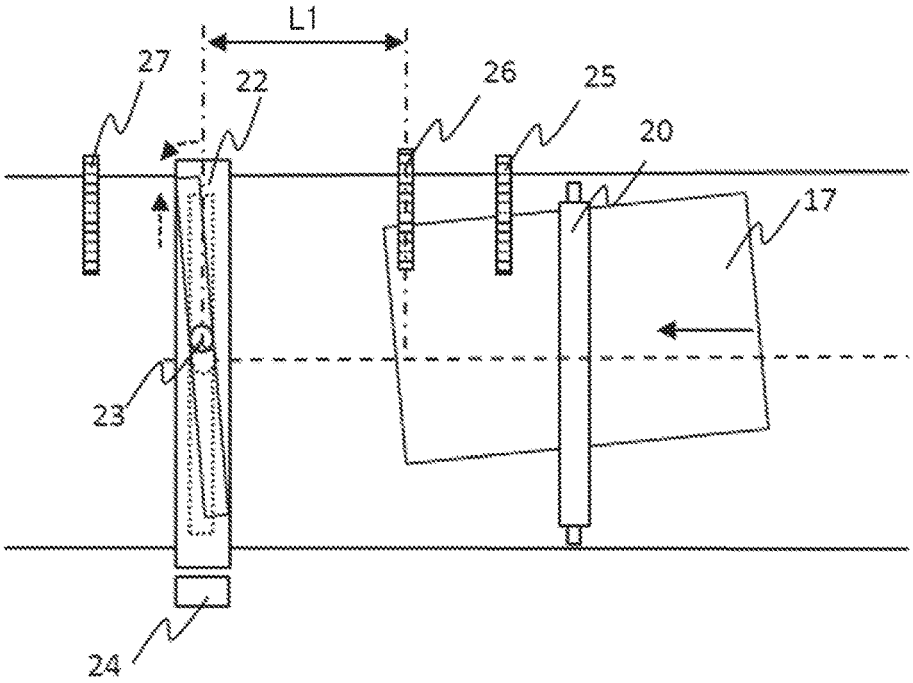
FIG. 15A is a diagram illustrating a step of a process of sheet conveyance by the comparative sheet conveying device.
Figure 15B:
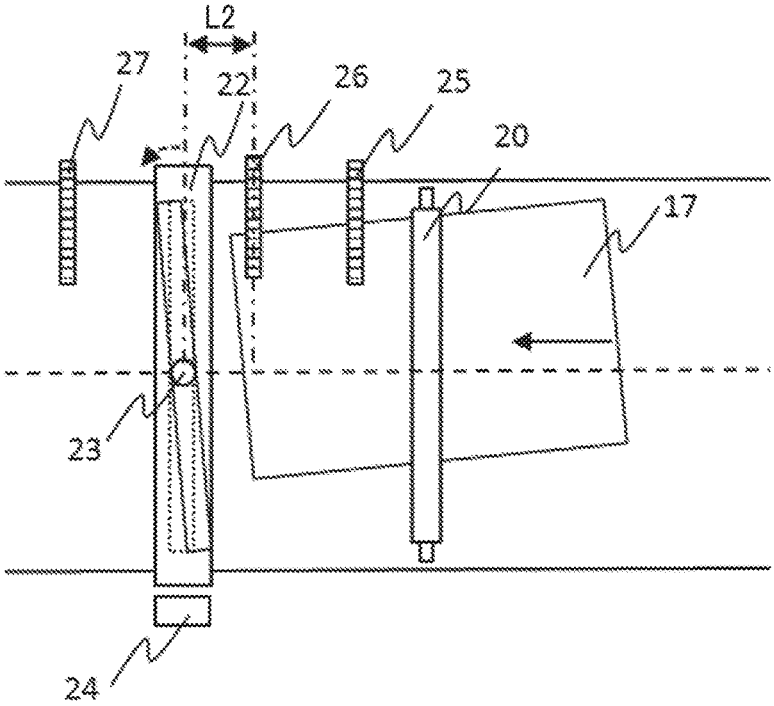
FIG. 15B is a diagram illustrating a step of a process of sheet conveyance by the sheet conveying device according to the present embodiment of this disclosure.
Figure 17:
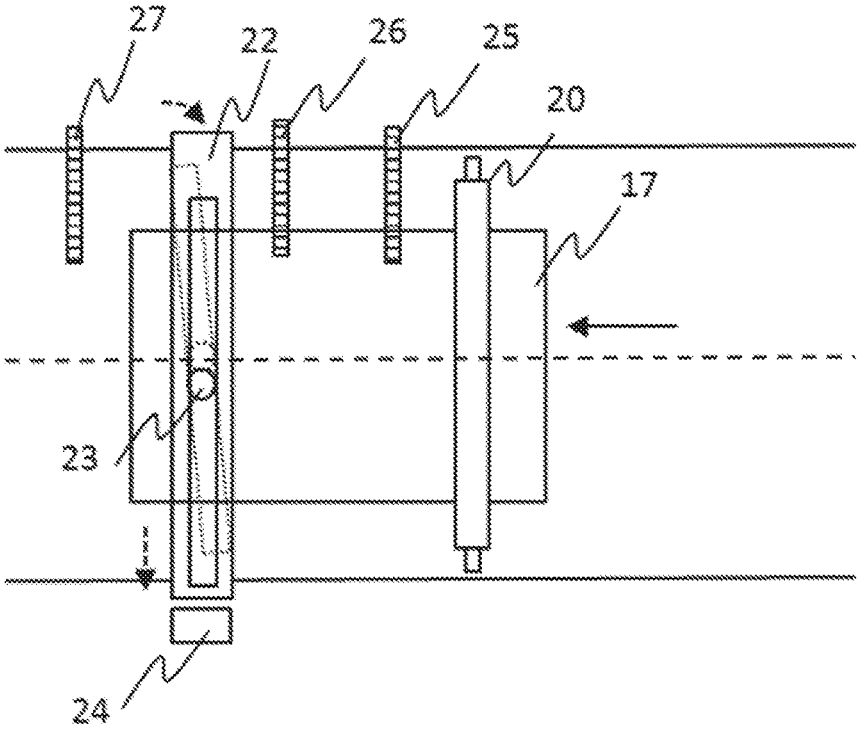
FIG. 17 is a diagram illustrating another subsequent step of the process of sheet conveyance by the sheet conveying device of FIG. 16.

The term "CW" of the rotation motor operation and the shift motor operation in the timing diagrams of FIGS. 12 and 13 indicates that the rotation motor 23*a* and the shift motor 24*a* rotate in a clockwise direction (i.e., a normal direction of rotation) when viewed from an output shaft side of the rotation motor 23*a* and the shift motor 24*a*. Similarly, the term "CCW" of the rotation motor operation and the shift motor operation in the timing diagrams of FIGS. 12 and 13 indicates that the rotation motor and the shift motor rotate in a counterclockwise direction (i.e., a reverse direction of rotation to the normal direction) when viewed from the output shaft side. By contrast, the registration mechanism 22 rotates in the CCW direction on the drawings when the rotation motor 23*a* rotates in the CW direction, as illustrated in FIGS. 15A and 15B. Accordingly, the direction of rotation of the rotation motor 23*a* is opposite the direction of rotation of the registration mechanism 22 on the drawings. Further, the registration mechanism 22 moves in an upward direction on the drawing when the shift motor 24*a* rotates in the CW direction, as illustrated in FIG. 15A. Further, the registration mechanism 22 moves in a downward direction on the drawing when the shift motor 24*a* rotates in the CCW direction, as illustrated in FIG. 17.

Figure 14:
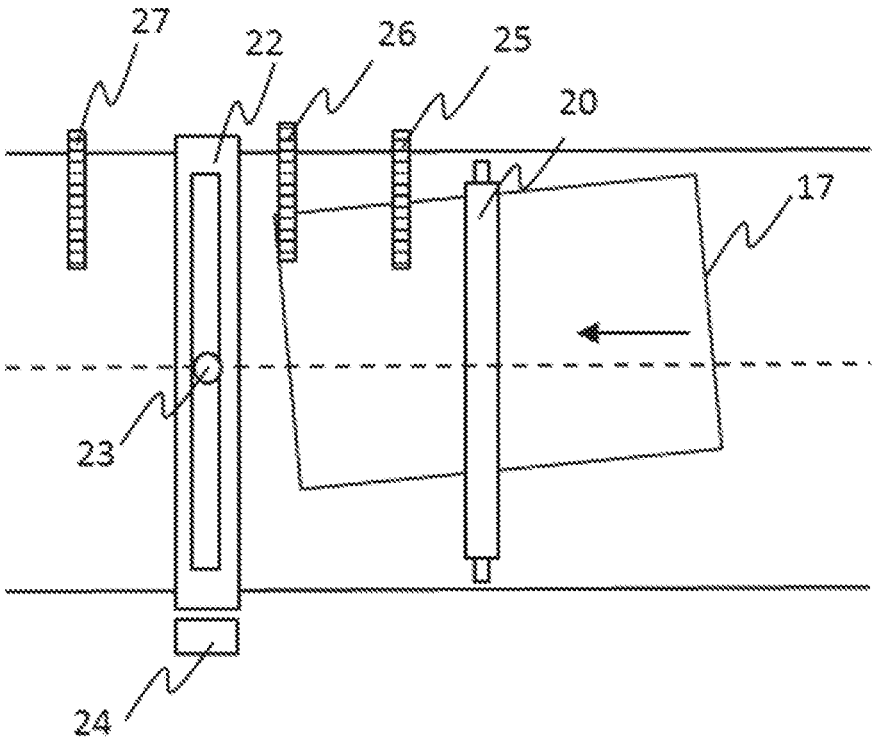
FIG. 14 is a diagram illustrating a step of a process of sheet conveyance by the sheet conveying device according to an embodiment of this disclosure.

FIG. 14 is a diagram illustrating a step of a process of sheet conveyance by the sheet conveying device 120 according to an embodiment of this disclosure. To be more specific, FIG. 14 illustrates an example of a state of conveyance of the sheet 17 in Time A in the timing diagrams of FIGS. 12 and 13.

The sheet 17 that has been fed from the sheet feeding device 110 is conveyed to the sheet conveyance passage 16. As the sheet 17 passes the pair of sheet conveying rollers 20, the pair of sheet conveying rollers 20 grips the sheet 17 and conveys the sheet 17 toward the registration mechanism 22. Arrow in FIG. 14 indicates the sheet conveying direction of the sheet 17. The sheet 17 that is being conveyed toward the registration mechanism 22 is detected by the first edge sensor 25. Then, a time after the second edge sensor 26 detects the sheet 17 corresponds to Time A. In Time A, based on the detection results of the sheet 17 detected by the first edge sensor 25 and the second edge sensor 26, the amount of angular displacement of the sheet 17 and the amount of lateral displacement of the sheet 17 are calculated.

In accordance with the calculation result, the amount of rotational operation of the pair of registration rollers of the registration mechanism 22 and the amount of shift operation of the pair of registration rollers of the registration mechanism 22 are determined in a unit of encoder pulse. The amount of rotational operation of the pair of registration rollers that is determined here is an amount to cancel (eliminate) the amount of angular displacement of the sheet 17 (i.e., the positional deviation in the direction of rotation of the sheet 17). Similarly, the amount of shift operation of the pair of registration rollers that is determined here is an amount to cancel (eliminate) the amount of lateral displacement of the sheet 17 (i.e., the positional deviation in the main scanning direction, i.e., the width direction of the sheet 17).

FIGS. 15A and 15B are examples of respective states of conveyance of the sheet 17 in Time B. Specifically, FIG. 15A is a diagram illustrating a step of a process of sheet conveyance of the sheet 17 by the comparative sheet conveying device, FIG. 15B is a diagram illustrating a subsequent process of sheet conveyance of the sheet 17 by the sheet conveying device 120 according to the present embodiment of this disclosure.

In Time B, before the sheet 17 reaches the pair of registration rollers of the registration mechanism 22, the registration mechanism 22 performs a preparation operation (i.e., the pick up operation) to correct the attitude of the sheet 17. The time that is taken for the pick up operation is hereinafter referred to as a "pick up operation time." The pick up operation time due to the operation of the shift motor 24*a* is taken longer than the pick up operation time due to the operation of the rotation motor 23*a*.

In the comparative sheet conveying device, the pick up operation also includes the operation to correct the lateral displacement of the sheet 17. At this time, the pair of registration rollers also moves in the direction intersecting with the main scanning direction (e.g., the direction perpendicular to the main scanning direction). Therefore, according to the comparison of the timing diagram of FIG. 12 and the timing diagram of FIG. 13, the period of Time B of the sheet conveying device 120 according to the present embodiment of this disclosure is shorter than the period of Time B of the comparative sheet conveying device.

In the pick up operation performed by the sheet conveying device 120 according to the present embodiment, the registration mechanism 22 does not cause the shift motor 24*a* to rotate during the pick up operation time but causes the rotation motor 23*a* to rotate with the pair of registration rollers staying put at the home position in the width direction of the pair of registration rollers. in the pick up operation performed by the sheet conveying device 120 according to the present embodiment, the shift motor 24*a* does not rotate but the rotation motor 23*a* rotates, so as to perform a rotational operation to cause the axial direction of the pair of registration rollers of the registration mechanism 22 to be parallel to the edge of the leading end of the sheet 17 to be conveyed to the pair of registration rollers. Accordingly, the pick up operation performed by the sheet conveying device 120 according to the present embodiment completes before the sheet 17 reaches the registration mechanism 22, and therefore reduces the time of operation when compared with the pick up operation performed by the comparative sheet conveying device. In general, the shift operation of the pair of registration rollers of the registration mechanism 22 (i.e., an operation in which the pair of registration rollers of the registration mechanism 22 moves in the width direction) significantly depends on the weight of the registration mechanism 22 and the motor torque of the shift motor 24*a*, By contrast, in the rotational operation of the pair of registration rollers, the weight of the registration mechanism 22 and the motor torque of a registration motor are not so susceptible to the "pick up operation time". The heavier the registration mechanism 22 is or the smaller the motor torque of the shift motor 24*a* is, the longer the period of Time B becomes (FIG. 12).

As described above, the sheet conveying device 120 according to the present embodiment of this disclosure reduces the pick up operation time when compared with the comparative sheet conveying device. Accordingly, the distance from the second edge sensor 26 in the sheet conveyance passage of the sheet 17 to the pair of registration rollers of the registration mechanism 22 (i.e., a conveyance distance L2) is shorter smaller) than the distance from the second edge sensor 26 in the sheet conveyance passage of the sheet 17 to the pair of registration rollers of the registration mechanism 22 (i.e., a comparative distance L1). In other words, the sheet conveying device 120 according to the present embodiment of this disclosure reduces a sheet position correction time to correct the position of the sheet 17.

Figure 16:
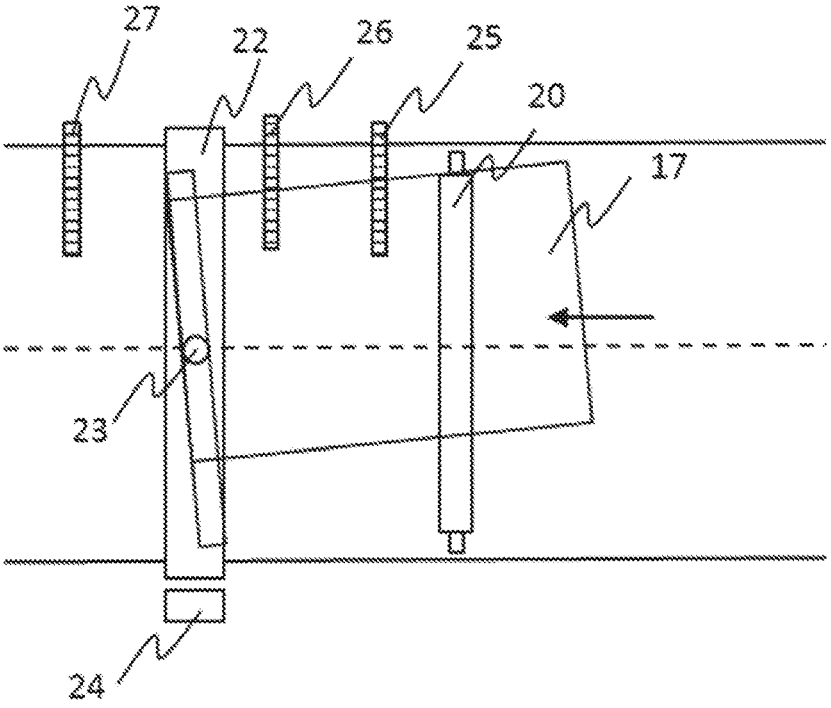
FIG. 16 is a diagram illustrating a subsequent step of the process of sheet conveyance by the sheet conveying device of FIG. 15B.

FIG. 16 is a diagram illustrating a subsequent step of the process of sheet conveyance by the sheet conveying device 120. FIG. 17 is a diagram illustrating another subsequent step of the process of sheet conveyance by the sheet conveying device 120.

Time C corresponds to a period of time during which the registration mechanism 22 performs the "adjustment operation (step S403 in the flowchart of FIG. 4)" to return from the pick up operation and correct the attitude of the sheet 17. Time C is also referred to as a "return time." The pick up operation is performed by the comparative sheet conveying device based on the amount of angular displacement and the amount of lateral displacement of the sheet 17. Consequently, the adjustment operation is performed to correct the angular displacement and the lateral displacement of the sheet 17. To be more specific, in order to return the pair of registration rollers to the home position, the rotation drive device 23 controls the operation of the rotation motor 23*a* to correct the angular displacement of the sheet 17 and the main scanning drive device 24 controls the operation of the shift motor 24*a* to correct the lateral displacement of the sheet 17.

By contrast, the sheet conveying device 120 according to an embodiment of this disclosure performs the pick up operation to correct the angular displacement of the sheet 17 and does not correct the lateral displacement of the sheet 17. In order to correct the lateral displacement of the sheet 17, the sheet conveying device 120 according to the present embodiment performs, in the adjustment operation (i.e., Time C), the rotational operation to correct the angular displacement of the sheet 17 and the shift operation to correct the lateral displacement of the sheet 17 at the same time. In other words, in the sheet conveying device 120 according to the present embodiment of this disclosure, the shift operation in the adjustment operation is not an operation to return the pair of registration rollers to the home position but is an operation to cause the pair of registration rollers at the home position to perform the shift operation to correct the lateral displacement of the sheet 17.

As illustrated in FIG. 16, the leading end of the sheet 17 in the sheet conveying direction is conveyed to the pair of registration rollers that has completed the pick up operation. At this time, the rollers of the pair of sheet conveying rollers 20 are in contact with each other and form a nip region to grip the sheet 17. By contrast, the rollers of the pair of sheet conveying rollers 20 separate from each other to cancel the nip region when releasing the sheet 17. Thereafter, as illustrated in FIG. 17, the shift motor 24*a* drives the pair of registration rollers to move the sheet 17 in the sheet conveying direction while the pair of registration rollers grips the sheet 17 in the nip region formed between the rollers of the pair of registration rollers. Simultaneously, the rotation motor 23*a* causes the pair of registration rollers that is rotated in the direction of rotation of the sheet 17 to rotate in the opposite direction to return to the home position (i.e., a state in which the nip region of the pair of registration rollers is extended in a direction perpendicular to the sheet conveying direction). While the pair of registration rollers is rotating as described above, the shift motor 24*a* drives the pair of registration rollers to move in the correcting direction (i.e., the width direction) by the correction amount of positional deviation of the sheet 17 in the width direction (i.e., the amount of lateral displacement of the sheet 17) calculated in the pick up operation (step S402 in the flowchart of FIG. 4). Accordingly, while gripping the sheet 17 in the nip region, the pair of registration rollers performs the shift operation to correct the lateral displacement of the sheet 17 while rotating in the direction to correct the angular displacement of the sheet 17. The "returning operation" that includes the rotational operation and the shift operation completes before the sheet 17 reaches the third edge sensor 27.

Figure 18:
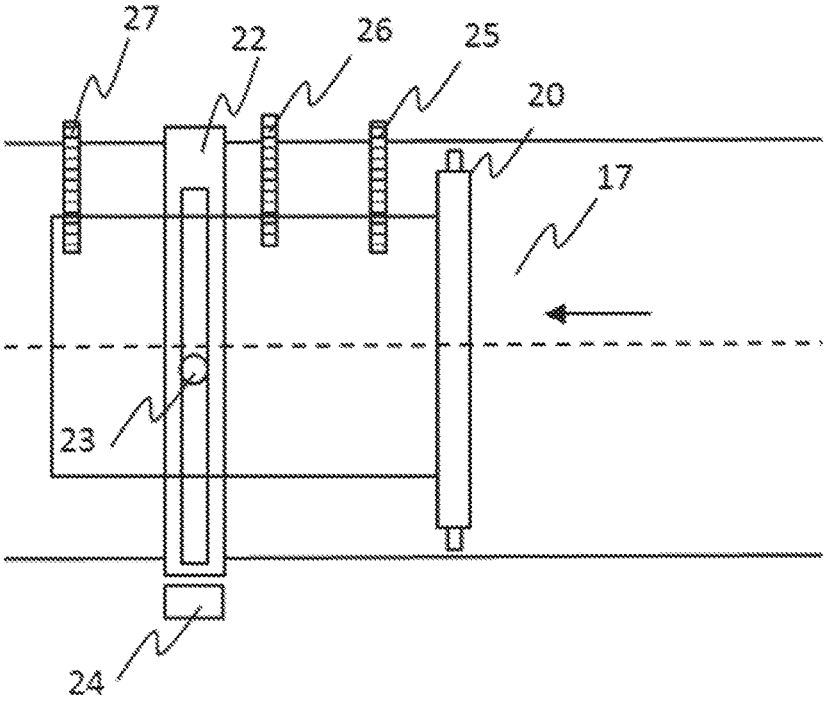
FIG. 18 is a diagram illustrating yet another subsequent step of the process of sheet conveyance by the sheet conveying device of FIG. 17.

FIG. 18 is a diagram illustrating another state in which the sheet 17 is conveyed in the sheet conveying device 120 according to the present embodiment of this disclosure in Time D that comes after Time C.

Time D corresponds to a feedback time of the positional deviation amount of the sheet 17 detected by the second edge sensor 26 and the third edge sensor 27.

As illustrated in FIG. 17, when the sheet 17 reaches the third edge sensor 27, the amount of angular displacement of the sheet 17 and the amount of lateral displacement of the sheet 17 are calculated based on the detection result of the edge in the width direction of the sheet 17 detected by the second edge sensor 26 and the third edge sensor 27. It is to be noted that the amounts of positional deviation of the sheet 17 by the second edge sensor 26 and the third edge sensor 27 are continuously calculated in Time E that follows Time D.

Figure 19:
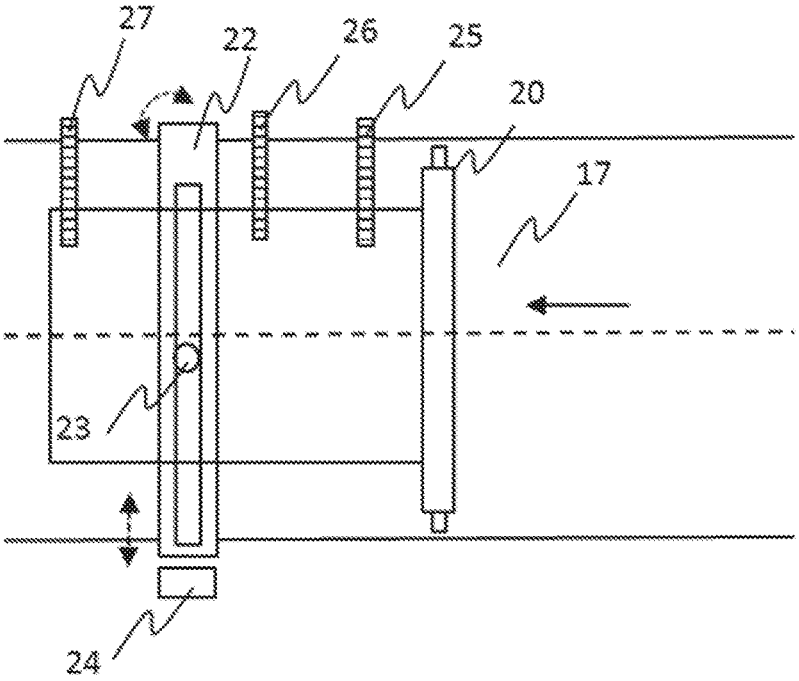
FIG. 19 is a diagram illustrating yet another subsequent step of the process of sheet conveyance by the sheet conveying device of FIG. 18.

FIG. 19 is a diagram illustrating yet another state in which the sheet 17 is conveyed in the sheet conveying device 120 according to the present embodiment of this disclosure in Time E.

Time E corresponds to a feedback recorrection time to correct the positional deviation of the sheet 17 calculated in Time D.

Even in Time E, the amount of positional deviation of the sheet 17 is calculated for multiple times and, each time the amount of positional deviation of the sheet 17 is calculated, the operation to correct the positional deviation of the sheet 17 is appropriately performed. Therefore, after the rotation motor 23*a* and the shift motor 24*a* have been moved to correct the amount of positional deviation of the sheet 17 calculated in Time D, the feedback recorrecting operation is performed for multiple times at predetermined timings until Time E ends. When Time E ends, the feedback recorrecting operation completes. Therefore, the rollers of the pair of registration rollers separate from each other in Time F that comes after Time E.

Figure 20:
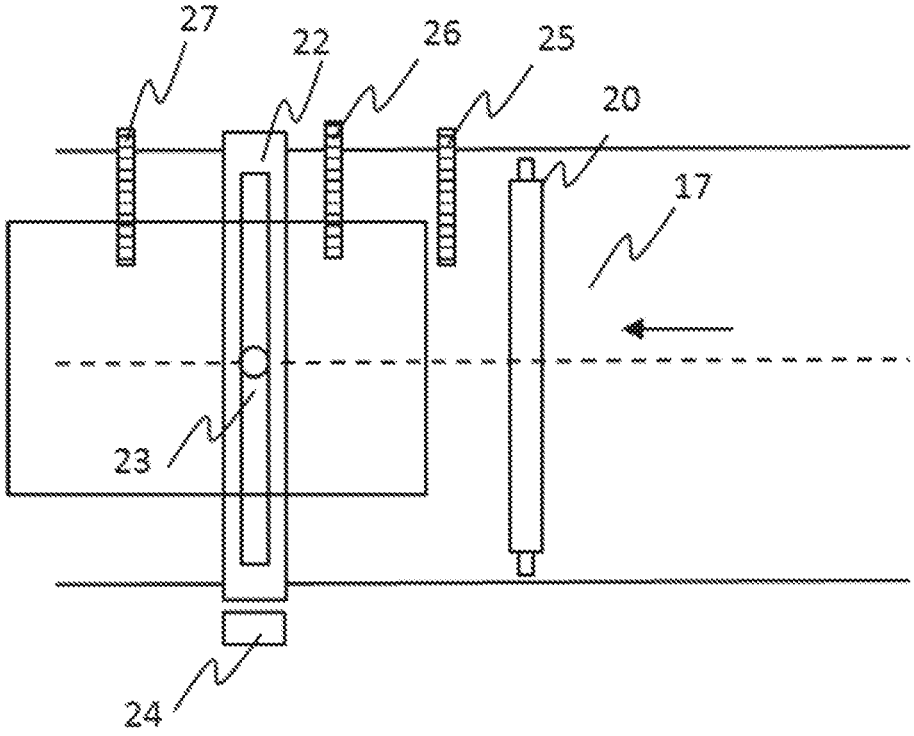
FIG. 20 is a diagram illustrating yet another subsequent step of the process of sheet conveyance by the sheet conveying device of FIG. 19.

FIG. 20 is a diagram illustrating yet another state in which the sheet 17 is conveyed in the sheet conveying device 120 according to the present embodiment of this disclosure in Time F.

Time F corresponds to a position returning time of the pair of registration rollers.

In Time F, the sheet 17 is conveyed by the pair of registration rollers to reach a subsequent step. Consequently, the rollers of the pair of registration rollers are separated from each other, and the nip region formed between the rollers of the pair of registration rollers to grip the sheet 17 is cancelled. Then, the registration mechanism 22 causes the pair of registration rollers to return to the home position to prepare for conveyance of a subsequent sheet. In the process (flow) of the pick up operation according to the present embodiment, the shift operation of the pair of registration rollers is not performed in the pick up operation but the pair of registration rollers is moved in the direction to correct the amount of lateral displacement of the sheet 17 in the adjustment operation. Therefore, before the start of Time F, the pair of registration rollers of the sheet conveying device 120 according to the present embodiment of this disclosure is shifted in a direction different from the pair of registration rollers of the comparative sheet conveying device.

According to the above-described configuration, the sheet conveying device 120 according to the present embodiment of this disclosure reduces a sheet position correcting time to perform correction of the position of the sheet 17. Accordingly, the configuration of the sheet conveying device 120 is reduced and the positional deviation of the sheet 17 is corrected effectively even when the torque of the shift motor 24*a* is relatively small.

Next, a description is given of the sheet conveying device 120 according to another embodiment of this disclosure.

In the present embodiment, the adjustment operation (step S403 in the flowchart of FIG. 4) and the feedback recorrecting operation (step S404 in the flowchart of FIG. 4) are performed simultaneously. By so doing, a time to be taken from the start of the attitude correcting operation of the sheet 17 to the end of the attitude correcting operation of the sheet 17 is further reduced.

Figure 21:
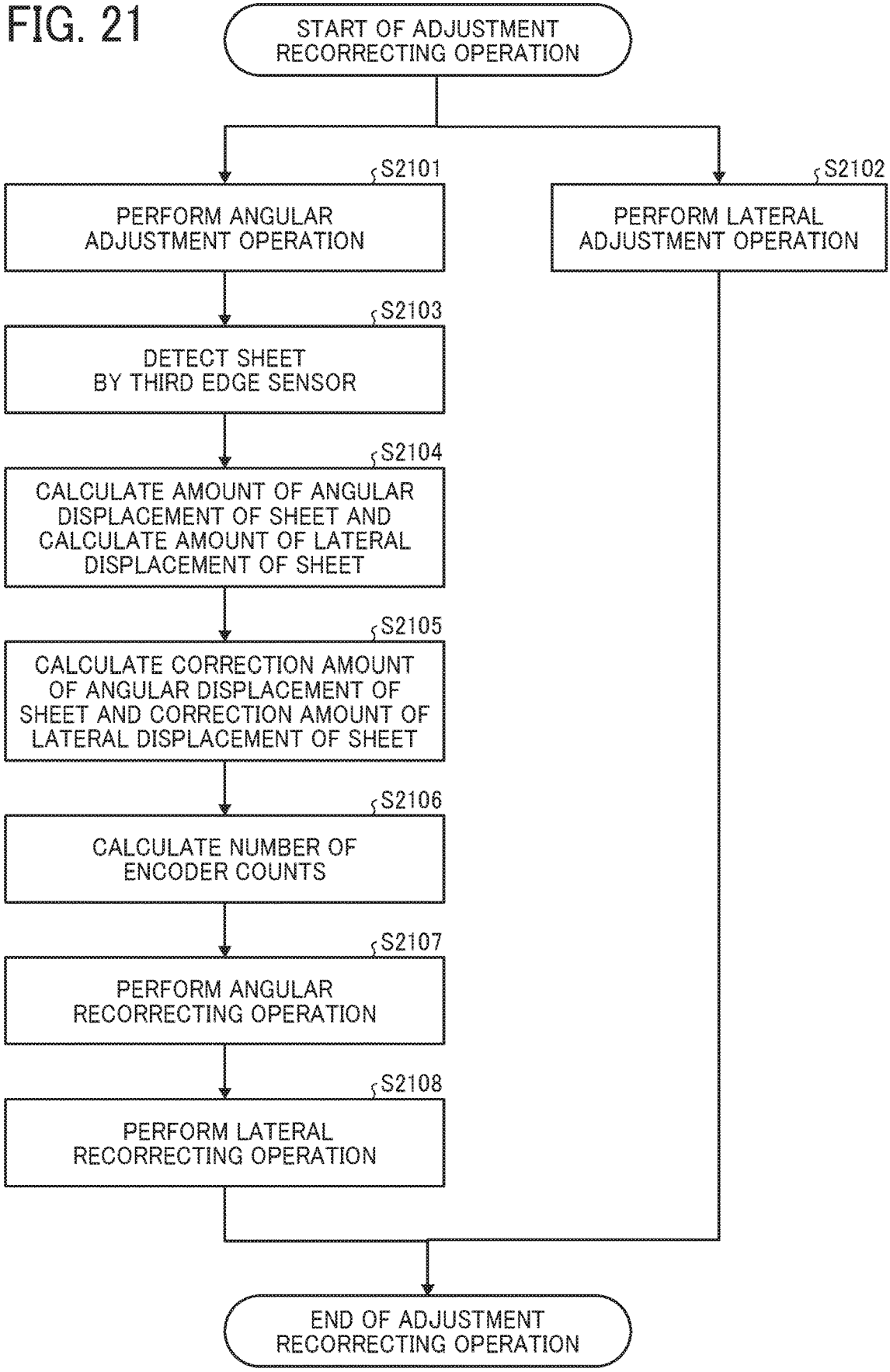
FIG. 21 is a flowchart of an adjustment recorrecting operation performed by the sheet conveying device according to an embodiment of this disclosure.

FIG. 21 is a flowchart of an adjustment recorrecting operation performed by the sheet conveying device 120 according to an embodiment of this disclosure.

First, the rotation motor 23*a* of the rotation drive device 23 is controlled to perform the angular adjustment operation to correct the angular displacement of the sheet 17 (step S2101 in the flowchart of FIG. 21). Thereafter, the shift motor 24*a* of the main scanning drive device 24 is controlled to perform the lateral adjustment operation to correct the lateral displacement of the sheet 17 (step S2102 in the flowchart of FIG. 21). The lateral adjustment operation in S2102 takes more time than the angular adjustment operation in S2101. In order to address this inconvenience, the third edge sensor 27 detects the sheet 17 during the lateral adjustment operation (step S2013 of the flowchart of FIG. 21). Then, the amount of positional deviation of the sheet 17 (i.e., the amounts of angular and lateral displacements of the sheet 17) with respect to the sheet conveying direction of the sheet 17 that has been detected by the second edge sensor 26 and the third edge sensor 27 is calculated (step S2104 in the flowchart of FIG. 21). Subsequently, the correction amount of angular displacement to be used to correct the amount of angular displacement of the sheet 17 and the correction amount of lateral displacement to be used to correct the amount of lateral displacement of the sheet 17 calculated in step S2104 are calculated (step S2105 in the flowchart of FIG. 21). Then, the number of encoder counts corresponding to the correction amount of angular displacement and the number of encoder counts corresponding to the correction amount of lateral displacement are calculated (step S2106 in the flowchart of FIG. 21). Thereafter, by using the number of encoder counts corresponding to the correction amount of angular displacement and the number of encoder counts corresponding to the correction amount of lateral displacement calculated in step S2106, the operation of the rotation motor 23*a* is controlled according to the number of encoder counts corresponding to the correction amount of angular displacement of the sheet 17, so that the pair of registration rollers of the registration mechanism 22 is rotated in the direction in which the amount of angular displacement of the sheet 17 is corrected (S2107 in the flowchart of FIG. 21).

After step S2107, the pair of registration rollers of the registration mechanism 22 is moved in the direction to correct the amount of lateral displacement of the sheet 17 (step S2108 in the flowchart of FIG. 21). The sheet 17 is detected for multiple times in step S2101. Each time the sheet 17 is detected in step S2101, the processes in steps S2103 through S2108 in the flowchart of FIG. 21 are executed continuously. In other words, in the feedback recorrecting operation performed by the sheet conveying device 120 according to the present embodiment of this disclosure, each time the third edge sensor 27 detects the sheet 17 at a predetermined timing, the correction amount of angular displacement of the sheet 17 and the correction amount of lateral displacement of the sheet 17 are calculated (step S2104 in the flowchart of FIG. 21). Then, an angular recorrecting operation is performed (step S2107 in the flowchart of FIG. 21), and a lateral recorrecting operation is performed (step S2108 in the flowchart of FIG. 21).

Figure 22:
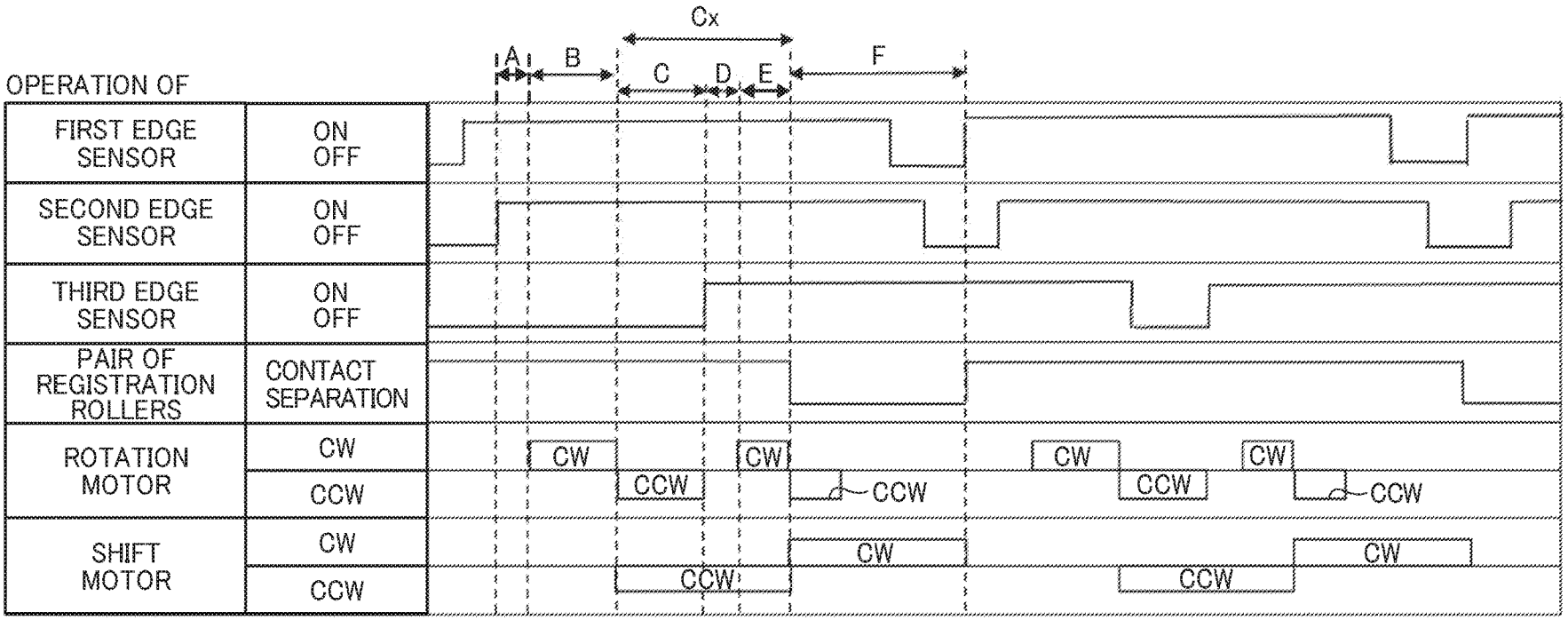
FIG. 22 is a timing chart of another sheet conveying operation performed by the sheet conveying device according to an embodiment of this disclosure.

A description is given of the above-described operation of the sheet conveying device 120 according to the present embodiment of this disclosure, with reference to a timing diagram of FIG. 22.

FIG. 22 is a timing diagram of another sheet conveying operation performed by the sheet conveying device 120 according to an embodiment of this disclosure.

Since the details of the timing diagram of FIG. 12 with respect to the operation performed by the comparative sheet conveying device and the details of the timing diagram of FIG. 13 with respect to the sheet conveying device 120 according to the present embodiment, i.e., Embodiment 1 of this disclosure are described above, a description is given of operations different from the operations related to the timing diagrams of FIGS. 12 and 13.

As illustrated in FIG. 22, Times A, B, and F in the timing diagram of FIG. 22 are the same as Times A, B, and F in Embodiment 1.

Time Cx is a period of an operation in which the rotation drive device 23 controls rotation of the rotation motor 23*a* to correct the angular displacement of the sheet 17, so that the registration mechanism 22 returns from the pick up operation, while the shift motor 24*a* is driving to correct the lateral displacement of the sheet 17 in Time C according to Embodiment 1 (Time C). Thereafter, during Time Cx, the third edge sensor 27 detects the sheet 17 to enter Time D, so that the second edge sensor 26 and the third edge sensor 27 start the feedback time of the positional deviation of the sheet 17. Accordingly, the amounts of angular and lateral displacements of the sheet 17 that have been corrected during Time C are calculated again.

Following Time D during Time Cx, Time E starts to perform the feedback recorrecting operation to correct the amount of angular and lateral displacements of the sheet 17 calculated during Time D. Accordingly, the rotation motor 23*a* and the shift motor 24*a* drive to correct the amounts of angular and lateral displacements of the sheet 17 calculated in Time D. After completion of this operation, the rollers of the pair of registration rollers separate from each other.

By performing the operation according to the present embodiment, i.e., Embodiment 2 of this disclosure described above, the feedback control of the amount of positional deviation of a sheet after the adjustment operation of the sheet (Times D and E) is performed to recorrect the angular displacement of the sheet alone. Accordingly, the time from the start to the end of the sheet attitude correcting operation is reduced, and therefore a distance of conveyance of the sheet 17 for the sheet attitude correction is also reduced.

Next, a description is given of the sheet conveying device 120 according to yet another embodiment of this disclosure.

In the present embodiment, during the position returning operation (step S405 in the flowchart of FIG. 4), the sheet attitude detection to a subsequent sheet 17 (step S401 in the flowchart of FIG. 4) and the pick up operation (step S402 in the flowchart of FIG. 4) are performed simultaneously. Accordingly, the time from the start to the end of the sheet attitude correcting operation of the sheet 17 is further reduced.

FIG, 23 is a flowchart of the position returning operation performed by the sheet conveying device 120 according to the present embodiment of this disclosure.

Figure 23:
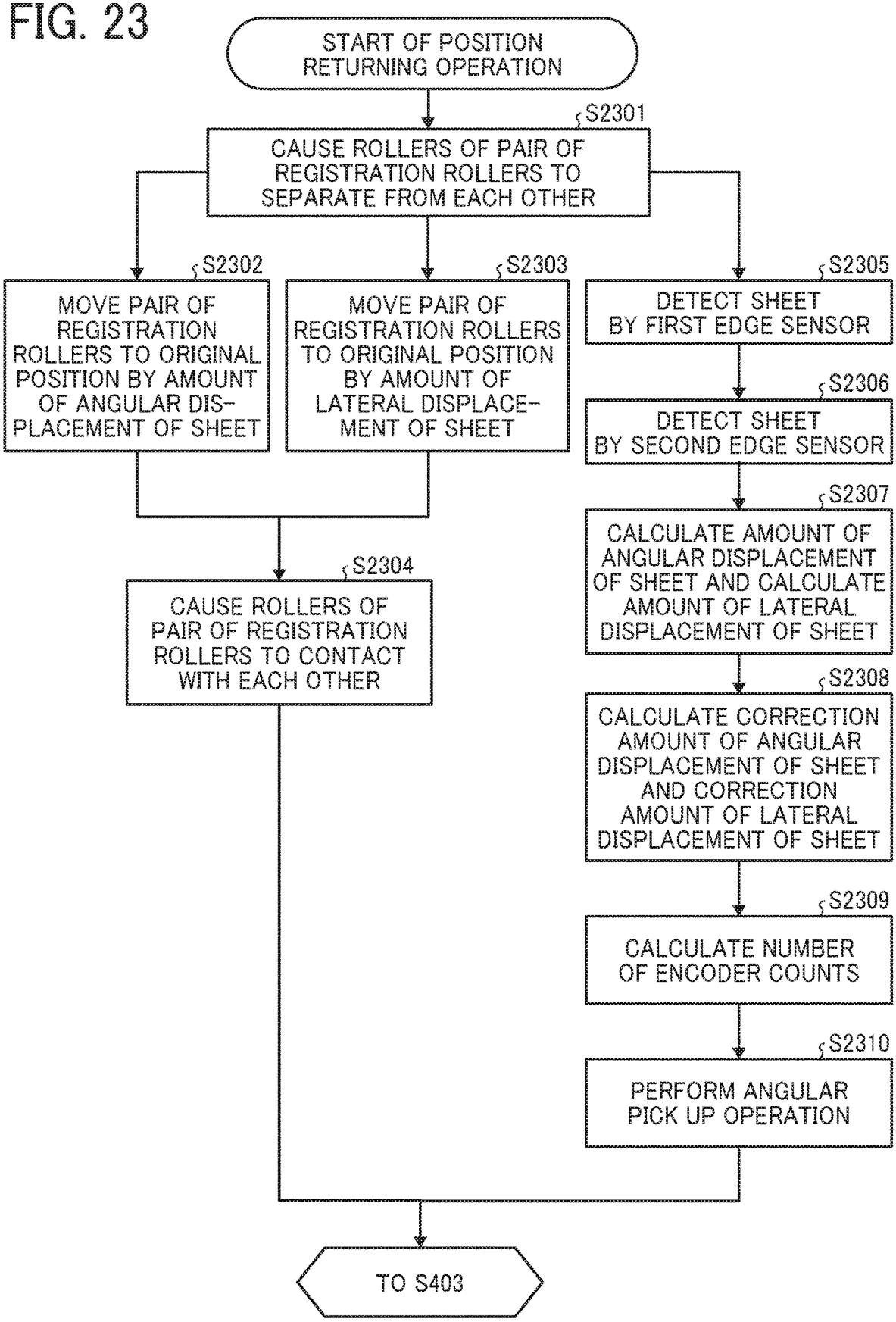
FIG. 23 is a flowchart of a position returning operation according to an embodiment of this disclosure.

First, the rollers of the pair of registration rollers are separated from each other (step S2301 in the flowchart of FIG. 23). The separation of the rollers of the pair of registration rollers causes the registration mechanism 22 to release the sheet 17 from the nip region of the pair of registration rollers. In the state in which the rollers of the pair of registration rollers are separated, even if the pair of registration rollers starts to rotate, this rotation does not change the attitude of the sheet 17. Therefore, in order to prepare for a subsequent sheet 17 to be conveyed, an operation to cause a rotation position of the pair of registration rollers to return to the original position (step S2302 in the flowchart of FIG. 23) and an operation to cause a shift position of the pair of registration rollers to return to the original position (step S2303 in the flowchart of FIG. 23) are performed at the same time. Then, the rollers of the pair of registration rollers that has returned to the original position contact to each other (step S2304 in the flowchart of FIG. 23). According to this operation, when a subsequent sheet 17 is conveyed, the pair of registration rollers grips the subsequent sheet 17, so that preparation for correction of the positional deviation of the subsequent sheet 17 is completed.

In the present embodiment, the subsequent sheet 17 may be conveyed while the operations in steps S2302 and 52303 in the flowchart of FIG. 23 are being performed. Therefore, while the operations in steps S2302 and S2303 in the flowchart of FIG. 23 are being performed, the first edge sensor 25 detects the edge in the width direction of the sheet 17 conveyed by the pair of sheet conveying rollers 20 (step S2305 in the flowchart of FIG. 23). Thereafter, as the sheet 17 reaches the second edge sensor 26, the second edge sensor 26 detects the edge in the width direction of the sheet 17 (step S2306 in the flowchart of FIG. 23). Then, based on the position of the edge of the sheet 17 detected by the first edge sensor 25 and the position of the edge of the sheet 17 detected by the second edge sensor 26, an amount of angular displacement of the sheet 17 and an amount of lateral displacement of the sheet 17 with respect to the sheet conveying direction of the sheet 17 are calculated (step S2307 in the flowchart of FIG. 23). Subsequently, the correction amount of angular displacement is calculated to be used to correct the amount of angular displacement of the sheet 17 and the correction amount of lateral displacement is calculated to be used to correct the amount of lateral displacement of the sheet 17 (step S2308 in the flowchart of FIG. 23). Then, the number of encoder counts corresponding to the correction amount of angular displacement and the number of encoder counts corresponding to the correction amount of lateral displacement are calculated (step S2309 in the flowchart of FIG. 23).

Thereafter, by using the number of encoder counts corresponding to the correction amount of angular displacement and the number of encoder counts corresponding to the correction amount of lateral displacement calculated in step S2309, the operation of the rotation motor 23*a* is controlled according to the number of encoder counts corresponding to the correction amount of angular displacement of the sheet 17, so that the angular pick up operation is performed to cause the pair of registration rollers of the registration mechanism 22 to rotate to be parallel to the leading end of the sheet 17 in the sheet conveying direction (step S2310 in the flowchart of FIG. 23). Thereafter, the process moves to the adjustment operation that is the same as the adjustment operation in Embodiment 1 (step S403 in the flowchart of FIG. 4). As described above, the sheet conveying device 120 according to the present embodiment of this disclosure does not perform the pick up operation to correct the lateral displacement of the sheet 17 but starts the pick up operation to correct the subsequent sheet 17 at the position returning operation. Therefore, the time taken from the start to the end of the position attitude correcting operation is further reduced.

A description is given of the operation of the sheet conveying device 120 according to the present embodiment of this disclosure, with reference to a timing diagram of FIG. 22.

Figure 24:
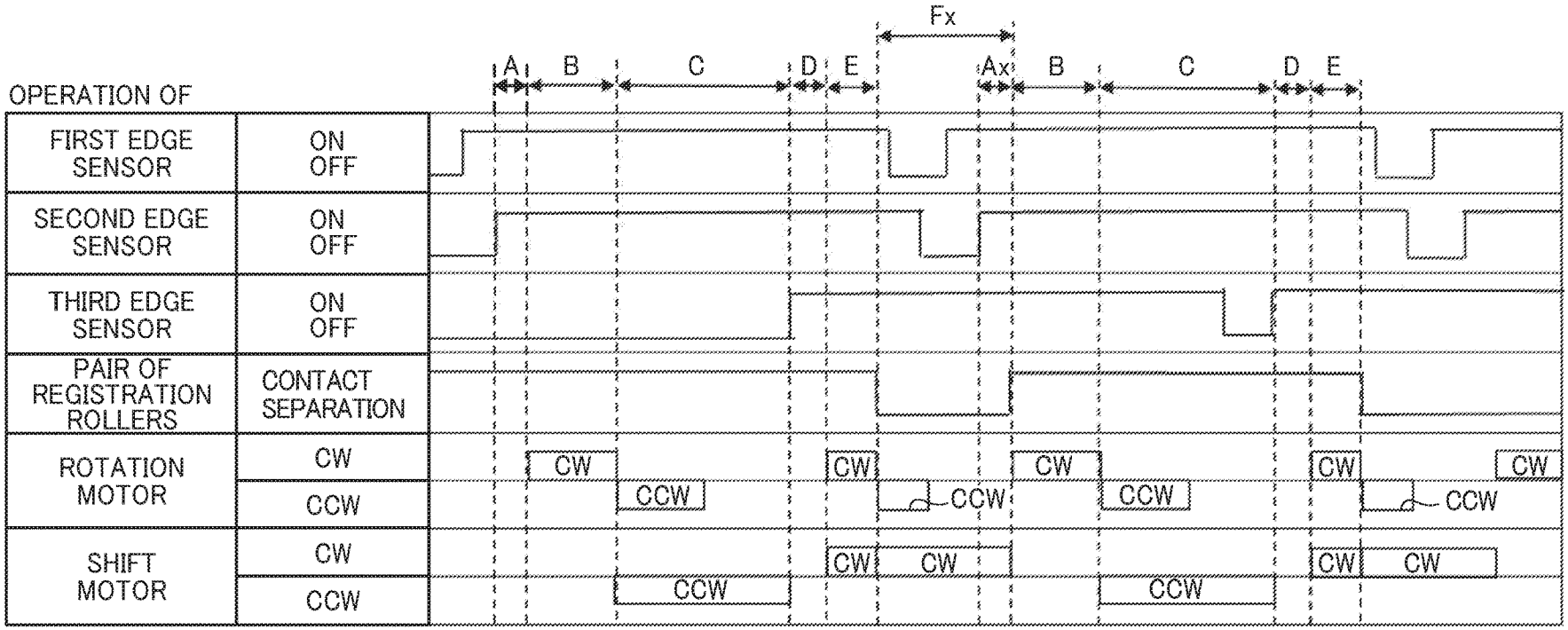
FIG. 24 is a timing diagram of yet another sheet conveying operation performed by the sheet conveying device according to an embodiment of this disclosure.

FIG. 24 is a timing diagram illustrating a sheet conveying operation according to an embodiment of this disclosure.

Since details of the timing diagram illustrated in FIG. 12 of the comparative sheet conveying device, details of the timing diagram illustrated in FIG. 13 of the sheet conveying device 120 according to Embodiment 1 of this disclosure, and details of the timing diagram illustrated in FIG. 22 of the sheet conveying device 120 according to Embodiment 2 of this disclosure are described above, a detailed description common to the timing charts of FIGS. 12, 13, and 22 is omitted here and a detailed description is given of operations of the sheet conveying device 120 with reference to a timing diagram of FIG. 24, which is different from the timing diagrams of FIGS. 12, 13, and 22.

FIG. 24 is a timing diagram of yet another sheet conveying operation according to an embodiment of this disclosure. As illustrated in FIG. 24, Time A, Time B, Time C, and Time E include the same operations as Embodiment 1.

Time Fx in the timing diagram of FIG. 24 is a period of operation in Time F according to Embodiment 1 of this disclosure to start the sheet attitude detection to detect a subsequent sheet 17.

After the feedback recorrection operation is performed in Time E and Time Fx, the rollers of the pair of registration rollers separate from each other. At this time, the attitude of the sheet 17 is not affected and is maintained even though the rotation motor 23*a* and the shift motor 24*a* are driven to cause the pair of registration rollers to return to the original position. Therefore, while the position returning operation is being performed after the end of Time E, the first edge sensor 25 and the second edge sensor 26 may detect a subsequent sheet 17 and the amount of positional deviation of the subsequent sheet 17 may be calculated (Time Ax). Thereafter, the adjustment operation may be performed sequentially. According to the above-described operations, a further reduction in a time to perform the sheet attitude correcting operation and a distance of conveyance of a sheet may be achieved.

Embodiment 2 may be applied with the present embodiment of this disclosure. In that case, a further reduction in a time to perform the sheet attitude correcting operation and a distance of conveyance of a sheet may be achieved.

It is to be noted that the configuration and functions of the inkjet image forming apparatus 100 are described as an image forming apparatus according to the present embodiment of this disclosure. However, the image forming apparatus to be applied to this disclosure is not limited to the above-described inkjet image forming apparatus 100. For example, an image forming apparatus 100 that is an electrophotographic image forming apparatus may also be applicable to this disclosure.

Figure 25:
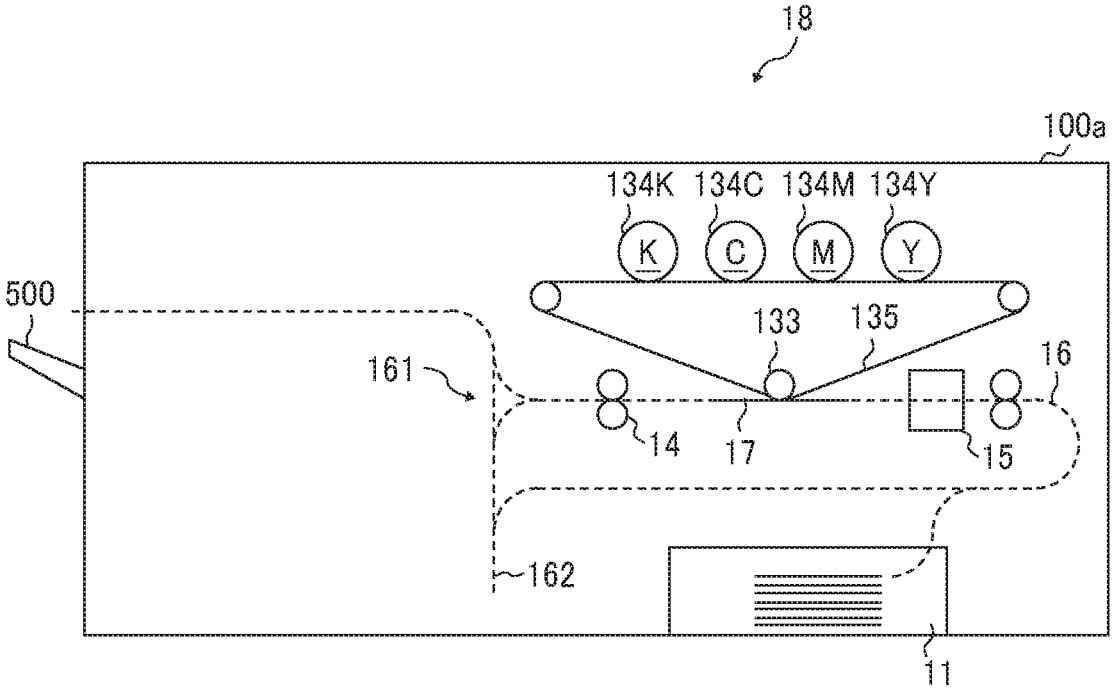
FIG. 25 is a diagram illustrating another configuration of the image forming apparatus according to an embodiment of this disclosure.

Next, a description is given of an overall configuration of the image forming apparatus 100*a* with reference to FIG. 25.

The image forming apparatus 100*a* includes a sheet feeding device 11, a sheet conveying device 15, an image forming device 18, a fixing roller 14, and a sheet ejection tray 500. The sheet conveying device 15 functions the same as the sheet conveying device 120 according to the above-described embodiments.

The image forming device 18 has a configuration in which photoconductor drums 134Y, 134M, 134C, and 134K of respective colors (i.e., yellow, magenta, cyan, and black) are disposed along a sheet conveying belt 135 that functions as an endless moving device. (Hereinafter, the photoconductor drums 134Y, 134M, 134C, and 134K are occasionally 2 0 referred to as the photoconductor drum 134). Such an image forming device, including the image forming device 18, having the above-described configuration is called as a tandem type image forming apparatus. In other words, multiple photoconductor drums, that is, the photoconductor drums 134Y 134M, 134C, and 134K are disposed in the order from the upstream side of a conveying direction of the sheet conveying belt 135 on which an intermediate transfer image to be transferred onto the sheet 17 that is fed from the sheet feeding device 11.

The respective single color images developed with toners Y, M, C, and K (i.e., yellow, magenta, cyan, and black) as colorants are respectively formed on the surfaces of the photoconductor drums 134Y, 134M, 134C and 134K and are sequentially transferred onto the surface of the sheet conveying belt 135, so that the respective single color images are superimposed one above the other to form a full color image on the sheet conveying belt 135. The full color image formed on the sheet conveying belt 135 as described above is transferred by a transfer roller 133 onto the sheet 17 that has been conveyed along the sheet conveyance passage 16, at a position at which the full color image comes closest to the sheet conveyance passage 16 indicated with broken lines in FIG. 25. Accordingly, the full color image is formed on the sheet 17.

As the sheet 17 on which the full color image is formed is further conveyed, the full color image is fixed to the sheet 17 by a fixing device including the fixing roller 14, Thereafter, the sheet 17 is conveyed to the outside of the apparatus body of the image forming apparatus 100*a*. Further, when duplex printing is performed, an image is formed on the first face (e.g., on the front face) of the sheet 17, and the sheet 17 to which the image is fixed to the first face is conveyed from a separation point 161 via a sheet reverse passage 162.

Accordingly, the sheet 17 is conveyed to the transfer position of the transfer roller 133 again in a state in which an image is ready to be formed on the second face (e.g., the back face) of the sheet 17, in other words, in a state in which the image formed on the sheet conveying belt 135 is ready to be transferred onto the second face of the sheet 17. Then, the sheet 17 is ejected to the sheet ejection tray 500 via a separation point 161.

The image forming apparatus 100*a* has a function to form a full color image on the sheet 17. However, the ffinction of the image forming apparatus 100*a* is not limited to the above-described function. For example, the image forming apparatus 100*a* may form a single color image employing a single toner of one of the photoconductor drums 134Y, 134M, 134C, and 134K. In addition, the image forming apparatus 100*a* may also form a two-color image or a three-color image employing two colors or three colors of the photoconductor drums 134Y, 134M, 134C, and 134K.

The image forming apparatus according to this disclosure is applicable not only to a color image forming apparatus as illustrated in FIGS. 1 and 25 but also to any of a monochrome image forming apparatus, a copier, a printer, a facsimile machine, or a multifunctional image forming apparatus including at least two functions of the copier, the printer, and the facsimile machine.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet conveying device, comprising:

a detector configured to detect an attitude of a conveyance target medium conveyed in a sheet conveying direction of the conveyance target medium;

a corrector configured to perform a correcting operation in which the corrector is configured to convey the conveyance target medium while gripping the conveyance target medium and correct, based on a detection result of the detector, the attitude of the conveyance target medium in a direction of rotation of the conveyance target medium relative to the sheet conveying direction and a direction perpendicular to the sheet conveying direction; and circuitry configured to:

calculate, based on the detection result of the, an angular displacement correction amount to correct an angular displacement of the conveyance target medium in the direction of rotation of the conveyance target medium and a lateral displacement correction amount to correct a lateral displacement of the conveyance target medium in the direction perpendicular to the sheet conveying direction, while the conveyance target medium is being conveyed;

cause the corrector to perform the correcting operation in the direction perpendicular to the sheet conveying direction, based on the lateral displacement correction amount, after the corrector grips the conveyance target medium; and cause the corrector to rotate by the angular displacement correction amount of the conveyance target medium before the corrector grips the conveyance target medium and with the corrector staying put at a predetermined position in the direction perpendicular to the sheet conveying direction, and to perform the correcting operation in the direction of rotation of the conveyance target medium, based on the angular displacement correction amount, after the corrector grips the conveyance target medium.

2. The sheet conveying device of claim 1, further comprising:

another detector, disposed downstream from the corrector in the sheet conveying direction, configured to detect the attitude of the conveyance target medium after the corrector has performed the correcting operation based on the detection result of the detector, wherein the circuitry is configured to control the correcting operation performed by the corrector with respect to the conveyance target medium based on another detection result of said another detector.

3. The sheet conveying device of claim 1, wherein the circuitry is configured to control the corrector to:

perform the correcting operation;

release the conveyance target medium from the corrector; and return to an original position of the corrector, prior to before the detector beginning to detect a subsequent conveyance target medium to be conveyed after the conveyance target medium.

4. The sheet conveying device of claim 3, wherein, upon the detector detecting the subsequent conveyance target medium while the circuitry is controlling the corrector to return to the original position of the corrector, the circuitry is configured to begin calculating the angular displacement correction amount of the subsequent conveyance target medium and the lateral displacement correction amount of the subsequent conveyance target medium.

5. The sheet conveying device of claim 1, wherein the circuitry is configured to rotate the corrector parallel to a leading end of the conveyance target medium in the sheet conveying direction, according to the angular displacement of the conveyance target medium.

6. An image forming apparatus comprising:

a sheet container configured to store a conveyance target medium;

an image forming device configured to form an image on the conveyance target medium;

the sheet conveying device of claim 1, configured to convey the conveyance target medium from the sheet container to the image forming device; and a sheet ejecting device configured to eject the conveyance target medium having the image.

7. A sheet conveying method comprising:

detecting an attitude of a conveyance target medium conveyed in a sheet conveying direction of the conveyance target medium;

gripping the conveyance target medium and conveying the conveyance target medium;

calculating an angular displacement correction amount to correct an angular displacement of the conveyance target medium based on a detection result detected by the detecting, while the conveyance target medium is being conveyed;

calculating a lateral displacement correction amount to correct a lateral displacement of the conveyance target medium in a direction perpendicular to the sheet conveying direction, based on the detection result detected by the detecting, while the conveyance target medium is being conveyed;

performing a correcting operation, via a corrector, in the direction perpendicular to the sheet conveying direction, based on the lateral displacement correction amount, after the gripping of the conveyance target medium;

rotating, by the angular displacement correction amount of the conveyance target medium before the gripping of the conveyance target medium and with the corrector staying put at a predetermined position in the direction perpendicular to the sheet conveying direction; and performing the correcting operation in a direction of rotation of the conveyance target medium, based on the angular displacement correction amount, after the gripping of the conveyance target medium.

8. A sheet conveying device, comprising:

a detector configured to detect an attitude of a conveyance target medium conveyed in a sheet conveying direction of the conveyance target medium;

a corrector configured to perform a correcting operation in which the corrector is configured to convey the conveyance target medium while gripping the conveying target medium and correct, based on a detection result of the detector, the attitude of the conveyance target medium in a direction of rotation of the conveyance target medium relative to the sheet conveying direction and a direction perpendicular to the sheet conveying direction; and circuitry configured to:

calculate, based on the detection result of the detector, an angular displacement correction amount to correct an angular displacement of the conveyance target medium in the direction of rotation of the conveyance target medium and a lateral displacement correction amount to correct a lateral displacement of the conveyance target medium in the direction perpendicular to the sheet conveying direction, while the conveyance target medium is being conveyed;

cause the corrector to perform the correcting operation in the direction perpendicular to the sheet conveying direction, based on the lateral displacement correction amount, after the corrector grips the conveyance target medium; and cause the corrector to rotate by the angular displacement correction amount of the conveyance target medium, before the corrector grips the conveyance target medium, and cause the corrector to perform the correcting operation in the direction of rotation of the conveyance target medium, based on the angular displacement correction amount calculated, after the corrector grips the conveyance target medium, wherein the circuitry is configured to control the corrector to:

perform the correcting operation;

release the conveyance target medium from the corrector; and return to an original position of the corrector, prior to the detector beginning to detect a subsequent conveyance target medium to be conveyed after the conveyance target medium, and wherein, upon the detector detecting the subsequent conveyance target medium while the circuitry is controlling the corrector to return to the original position of the corrector, the circuitry is configured to begin calculating the angular displacement correction amount of the subsequent conveyance target medium and the lateral displacement correction amount of the subsequent conveyance target medium.

9. The sheet conveying device of claim 8, further comprising:

another detector, disposed downstream from the corrector in the sheet conveying direction, configured to detect the attitude of the conveyance target medium subsequent to the corrector has performing the correcting operation, wherein the circuitry is configured to control the correcting operation performed by the corrector with respect to the conveyance target medium based on another detection result of said another detector.

10. The sheet conveying device of claim 8, wherein the circuitry is configured to rotate the corrector parallel to a leading end of the conveyance target medium in the sheet conveying direction, according to the angular displacement of the conveyance target medium.

11. An image forming apparatus comprising:

a sheet container configured to store a conveyance target medium;

an image forming device configured to form an image on the conveyance target medium;

the sheet conveying device of claim 8, configured to convey the conveyance target medium from the sheet container to the image forming device; and a sheet ejecting device configured to eject the conveyance target medium having the image.

* * * * *